US005767836A

United States Patent [19]

Scheffer et al.

[11] Patent Number: 5,767,836

[45] Date of Patent: *Jun. 16, 1998

[54] GRAY LEVEL ADDRESSING FOR LCDS

[75] Inventors: Terry J. Scheffer; Arlie R. Conner, both of Portland; Benjamin R. Clifton, Oregon City, all of Oreg.

[73] Assignee: In Focus Systems, Inc., Wilsonville, Oreg.

[ * ] Notice: The term of this patent shall not extend beyond the expiration date of Pat. No. 5,549,495.

[21] Appl. No.: 486,369

[22] Filed: Jun. 7, 1995

Related U.S. Application Data

[63] Continuation of Ser. No. 883,002, May 14, 1992, Pat. No. 5,459,495, and a continuation-in-part of Ser. No. 678,736, Apr. 1, 1991, Pat. No. 5,485,173.

[51] Int. Cl.[6] ..... G09G 3/36

[52] U.S. Cl. ..... 345/147; 345/89

[58] Field of Search ..... 345/87, 89, 147, 345/149, 100

[56] References Cited

U.S. PATENT DOCUMENTS

| | | | |
|---|---|---|---|
| 3,955,187 | 5/1976 | Bigelow | 340/784 |
| 3,997,719 | 12/1976 | Judice | 178/7.3 D |
| 4,043,640 | 8/1977 | Berreman | 350/160 LC |
| 4,427,978 | 1/1984 | Williams | 345/89 |
| 4,508,427 | 4/1985 | Ross | 350/335 |
| 4,560,982 | 12/1985 | Sonehara et al. | 340/784 |
| 4,709,995 | 12/1987 | Kuribayashi et al. | 350/350 S |
| 4,743,096 | 5/1988 | Wakai et al. | 350/333 |
| 4,752,774 | 6/1988 | Clerc et al. | 340/784 |
| 4,766,430 | 8/1988 | Gillette et al. | 340/793 |
| 4,769,713 | 9/1988 | Yasui | 358/236 |
| 4,776,676 | 10/1988 | Inoue et al. | 345/89 |
| 4,808,991 | 2/1989 | Tachiuchi et al. | 340/793 |
| 4,818,078 | 4/1989 | Mouri et al. | 350/350 S |
| 4,840,460 | 6/1989 | Bernot et al. | 350/333 |

(List continued on next page.)

FOREIGN PATENT DOCUMENTS

| | | | |
|---|---|---|---|
| 0127701 | 12/1984 | European Pat. Off. | G03B 21/132 |
| 0569974 | 11/1993 | European Pat. Off. . | |

OTHER PUBLICATIONS

Yoshio Suzuki, Mitsunobu Sekiya, Kunihiko Arai and Akio Ohkoshi, "A Liquid–Crystal Image Display," SID 83 Digest, 32–33.

Sprokel, Gerald J., "The Physics and Chemistry of Liquid Crystal Devices," pp. 105–113, 1980.

Hideaki Kawakami, Hisao Hanmura and Eiji Kaneko, "Brightness Uniformity in Liquid Crystal Displays," SID Digest, 28–29.

Ruckmongathan, "A generalized addressing technique for RMS responding Matrix LCDs," 1988 IDRC, pp. 80–85.

Lagerwall, "Ferroelectric Liquid Crystal for Displays," 1985 IDRC, pp. 213–221.

"1988 International Display Research Conference" T.M. Ruckmongathan pp. 80–85.

"Pulse–Height Modulation (PHM) Gray Shading Methods for Passive Matrix LCD's" T. J. Scheffer. Japan Display 92, pp. 69–71.

*Primary Examiner*—Amare Mengistu

*Attorney, Agent, or Firm*—Stoel Rives LLP

[57] ABSTRACT

Method and apparatus for providing gray level addressing for passive liquid crystal display (LCD) panels having overlapping row and column electrodes defining pixels are disclosed. Depending upon whether the rows are being addressed by "standard" or "Swift" addressing, the signals for applying to the column electrodes are determined by different calculations, in all of which modes the amplitudes of the column signals are related to the gray level desired to be displayed by the individual pixels. For a split interval system, column signals of appropriate amplitude and polarity are applied during different subintervals of a characteristic time interval of the display panel depending upon the method of addressing the rows. In the full interval mode, the column signals applied over a full time interval are based on the desired gray level of all the pixels in the column, adjusted to provide the proper rms voltage across all the pixels so that they display the desired gray levels.

37 Claims, 14 Drawing Sheets

U.S. PATENT DOCUMENTS

| | | | |
|---|---|---|---|
| 4,840,462 | 6/1989 | Hartmann | 350/350 S |
| 4,929,058 | 5/1990 | Numao | 345/89 |
| 4,991,022 | 2/1991 | Canfield et al. | 345/121 |
| 5,010,327 | 4/1991 | Wakita et al. | 345/89 |
| 5,055,833 | 10/1991 | Hehlen | 340/805 |
| 5,062,001 | 10/1991 | Farwell et al. | 358/236 |
| 5,091,722 | 2/1992 | Kitajima et al. | 345/89 |
| 5,134,495 | 7/1992 | Frazier | 358/298 |
| 5,157,387 | 10/1992 | Momose et al. | 345/94 |
| 5,189,406 | 2/1993 | Humphries et al. | 340/793 |
| 5,280,280 | 1/1994 | Hotto | 345/94 |
| 5,420,604 | 5/1995 | Scheffer et al. | 345/100 |
| 5,489,918 | 2/1996 | Mosier | 345/89 |
| 5,489,919 | 2/1996 | Kuwata et al. | 345/100 |
| 5,583,530 | 12/1996 | Mano et al. | 345/89 |

FIG. 3B This Invention

FIG. 5B This Invention

GRAY LEVEL ADDRESSING FOR LCDS

This is a continuation of application Ser. No. 07/883,002, filed May 14, 1992, issued May 16, 1995 as U.S. Pat. No. 5,459,495, and a continuation-in-part of application Ser. No. 07/678,736, filed Apr. 1, 1991 and issued Jun. 16, 1996 as U.S. Pat. No. 5,485,173.

BACKGROUND OF THE INVENTION

1. Field of the Invention

This invention relates to addressing liquid crystal displays (LCDs) to provide a plurality of gray shades or levels for the displayed image and more particularly to an apparatus and method for providing a very high number of gray levels for a fast-responding passive matrix LCD.

LCDs are becoming increasingly useful for displaying images not only in projection system but as screens for television receivers and computers. As a consequence, there is a demand for even faster-responding, high information content LCDs that can provide a very large number of gray levels between white and black or a large color palette.

2. Discussion of the Prior Art

One method of providing gray scale for an LCD is known as frame modulation, exemplified by U.S. Pat. Nos. 4,752,744 and 5,062,001 and an article by Y. Suzuki, et al., "A Liquid-Crystal Image Display," 1983 *SID Digest of Technical Papers* XIV 32–33 (1983). In these frame modulated systems the pixels forming the image on the screen are turned "on" and "off" in different frames correlated to the gray level or shade of color desired. When applied to faster-responding LCDs, however, frame modulation causes "flicker" and "swim". The former is perceived by the viewer as if the image were being rapidly turned on and off, and in the latter, the image appears to have ripples or waves passing through it.

The so-called "pulse-width modulation" gray scale system, exemplified by U.S. Pat. No. 4,427,978 issued Jan. 24, 1984 and an article by H. Kawakami, et al., "Brightness Uniformity in Liquid Crystal Displays," 1980 *SID Digest of Technical Papers XXI*, 28–29 (1980), is limited in the number of distinct gray levels that it can produce. Pulse width modulation is physically incapable of providing gray levels of the order of 256 which are desirable to bring out the fine detail of images required in "multimedia" applications of LCDs. In pulse-width modulated systems, the pulses become narrower and the high frequency content of the drive signals increases with the number of gray levels. These higher frequencies are cut off by the low-pass RC filter action of the LCD panel, which makes it difficult to realize more than about 4 to 7 gray levels on the display.

SUMMARY OF THE INVENTION

It is therefore an object of this invention to overcome the difficulties of prior art systems by providing a very large number of gray levels for faster-responding, high information, rms-responding, passive matrix LCDs.

More particularly, the method and apparatus of this invention provide a number of gray levels for an LCD by modulating the amplitude or pulse height of the display column drive signals.

As will be hereinafter described, the "pulse-height" or amplitude modulation addressing systems of this invention may be accomplished either in a "split interval" mode or in a "full interval" mode. Each such mode may be employed in either "standard" addressing methods or the "Swift" addressing method described in a copending application for U.S. patent Ser. No. 678,736, filed Apr. 1, 1991 which is assigned to the assignee of the present invention.

All these methods and the apparatus implementations thereof have in common the provision of means for generating and applying column signals whose amplitudes at any given time are directly related to the "gray" level or shade of color desired to be displayed by the pixels of the LCD panel and which are applied to the electrodes by multilevel drivers.

The advantage of pulse height modulation in any of the forms described is that no matter how many gray levels are generated, there is no significant increase in high frequency components in the column signals.

BRIEF DESCRIPTION OF THE DRAWINGS

FIGS. 3A and 3B are schematic representations of the idealized voltages across a pixel comparing the prior art pulse-width modulation method (3A) with the pulse-height modulation method of this invention in the split interval, standard addressing mods (3B), showing the different voltage levels resulting from the application of signals to the row and column electrodes of FIG. 1.

FIGS. 5A and 5B are schematic representations of portions of idealized column signals respectively comparing those of the prior art pulse-width modulation method (5A) with the method of this invention in the split interval, standard addressing mode (5B) as applied to the column electrodes of FIG. 1.

DESCRIPTION OF THE PREFERRED EMBODIMENTS

LCD Panel Characteristics

Figure 1:
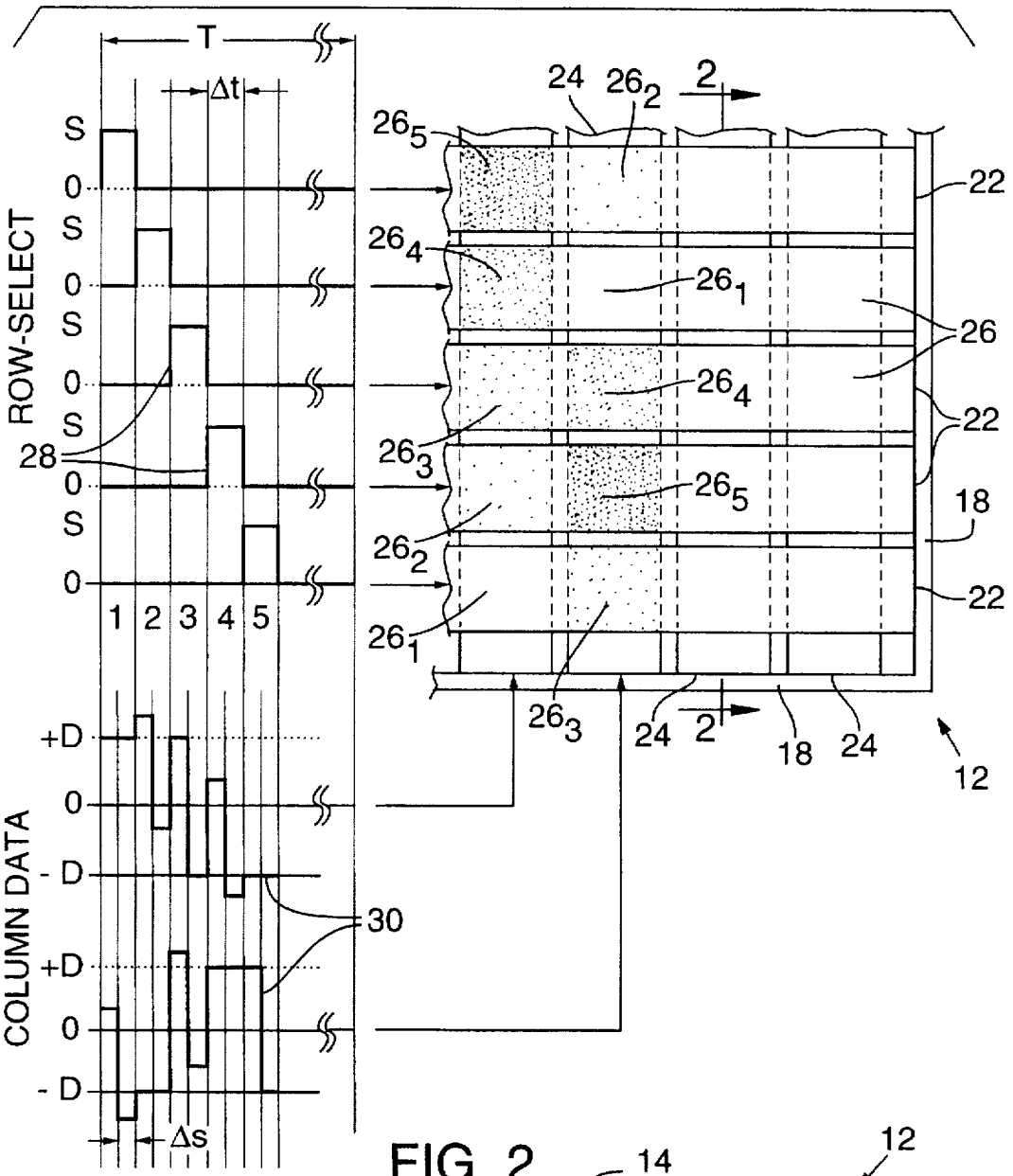
FIG. 1 is a semi-diagrammatic plan view of a portion of an LCD panel with a schematic representation of idealized signals applied to some of the row and column electrodes according to the method of this invention.

The method of this invention is applied to a typical flat panel display 12 (FIG. 1) of the type utilized in overhead projector panels, laptop computer screens and the like. High information content panels of this type operate through direct multiplexed, root mean square (rms)—responding electro-optical effects, such as the twisted nosatic (TN), supertwisted nematic (STN) or superhomeotropic (SH) liquid crystal display (LCD) effects.

Such panels typically comprise a pair of opposed, parallel, spaced glass plates or substrates 14, 16 (FIG. 2) between which an electro-optical material 21 such as a liquid crystal is disposed in the space between the substrates or call gap 20. A seal 18 around the edges of substrates 14, 16 serves to confine the liquid crystal material within the call gap.

Liquid crystal display panels are characterized by an inherent time constant, i.e., the time required for the liquid crystal director to return to its equilibrium state after it has been displaced by a dielectric torque induced by an electrical field applied to the liquid crystal. The time constant, $\tau$, is defined by $\tau=\eta d^2/K$, where $\eta$ is an average viscosity of the liquid crystal material, d is the cell gap spacing or pitch length and K is an average elastic constant of the liquid crystal material. For a conventional liquid crystal material in a 7–10 μm cell gap, the time constant $\tau$ is on the order of 200–400 ms (milliseconds). Also in typical multiplexed LCDs, the information is refreshed at a rate of 60 Hz corresponding to a frame period of 1/60 seconds or 16.7 ms.

Relatively recently, LCD panel time constants have been reduced to below 50 ms by making the gap, d, between the substrates thinner and by using newly synthesized liquid crystal materials which have lower viscosities and higher elastic constants. These faster-responding panels, generally designated as any panel below 150 ms response time, make possible high information content displays at video rates.

Figure 2:
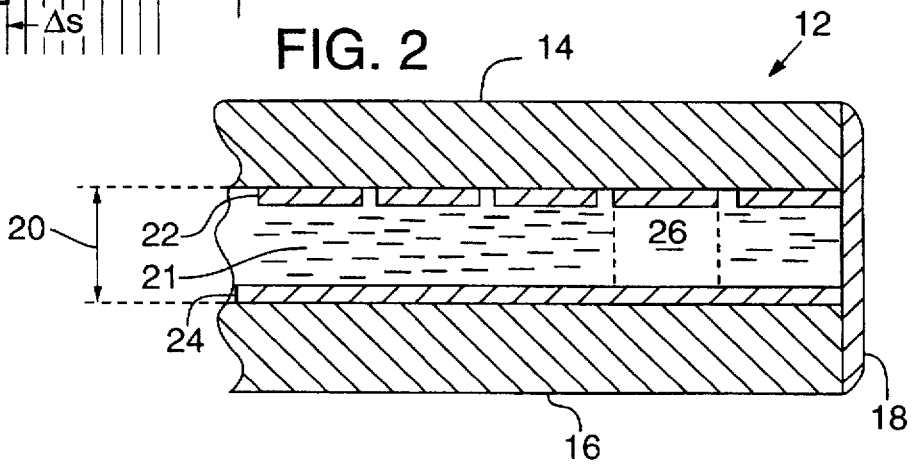
FIG. 2 is a cross-sectional view as seen from line 2—2 of FIG. 1.

In one common embodiment of an LCD panel, a matrix comprised of transparent electrodes is applied to the inner surfaces of the substrates, typically arranged in a plurality of horizontal or row or first electrodes 22 on the inner surface of substrate 14 and vertical or column or second electrodes 24 on the opposed inner surface of substrate 16 (FIGS. 1, 2). Each area where the row and column electrodes overlap or cross creates a picture element or "pixel" 26, by virtue of the matrix of which information is displayed on the panel 12. The arrangement of overlapping electrodes may take many forms, such as concentric rings and radial lines, although a matrix of row and column electrodes as disclosed is the most common pattern. High information content displays require large numbers of pixels to portray text and/or graphic images. Matrix LCDs having 480 rows and 640 columns forming 307,200 pixels are not uncommon and have provided high information content panels of approximately 10½-inch diagonal size.

Information is displayed on a panel such as 12 by the relative degree of transmittance of light through the pixels, either from a light source on the opposite side of the panel from the viewer or by virtue of reflected light. The optical state of a pixel, i.e., whether it appears dark, bright, or an intermediate shade is determined by the orientation of the liquid crystal director in the pixel area 26 (FIG. 2). The direction of orientation of the liquid crystal material in the pixel area and, hence, the transmittance of the pixel is changed by the application of an electrical field across the pixel. In direct multiplexed addressing techniques commonly used with matrix LCDs, the pixel "sees" an electrical field proportional to the difference in the signals, or voltages, applied to the respective electrodes on opposite sides of the pixel. Those signals of appropriate frequency, phase and amplitude are determined by the information to be displayed from a video signal or other source.

"Standard" Addressing

In standard addressing of an LCD panel of N rows by M columns without gray levels, row select pulses of amplitude +S and width $\Delta t$ are sequentially applied to the row electrodes, which are otherwise held at no signal or zero voltage during the remainder of the frame period (FIG. 1). As used herein, to "select" a row means that a non-zero voltage is applied to the row. At is the "characteristic time interval" for standard addressing and is equal to the frame period, T, divided by the number of row electrodes, N, thus T/N.

During the same frame period the column electrodes are each driven with a signal which is determined by the information to be displayed. For an "on" or "select" pixel, i.e., one which is to appear bright or have high transmittance, the column voltage is −D during the time interval that the row containing the pixel is addressed with a select pulse. For an "off" or "non-select" pixel, i.e., one which is to be in a dark or low or non-transmittance state, the column voltage is +D. Since the voltage applied to the pixel is the difference between the row and column voltages, a select pixel will "see" a pulse height or amplitude of S+D and a non-select pixel will "see" a pulse height of S−D during one time interval each frame period. During the remaining time intervals of the frame period the pixels "see" voltage levels switching between +D and −D.

For maximum selection ratio, which is the ratio of the select or "on" rms voltage applied across the pixel divided by the non-select or "off" rms voltage applied to the pixel, the signal amplitude, S, of the row select signal is optimally related to the amplitude D of the column signal by:

$$S=\sqrt{N}\,D$$

and D is related to the non-select rms pixel voltage $V_{ns}$ by:

$$D = V_{ns}\sqrt{\frac{\sqrt{N}}{2(\sqrt{N}-1)}},$$

where N is the number of multiplexed rows in the display.

The addressing technique referred to herein as "standard" addressing, is described in detail by P. Alt and P. Pleshko, "Scanning Limitations of Liquid Crystal Displays" in *IEEE Transactions of Electron Devices* Vol. ED-21, No. 2, February 1974, Pages 146–155. Subsequent improvements that have been made to eliminate D.C. voltages across the display and to decrease the power supply voltages and maximum voltage limits of the drive circuitry do not alter the basic principle of operation or its applicability to the gray level methods of this invention.

Figure 3A:
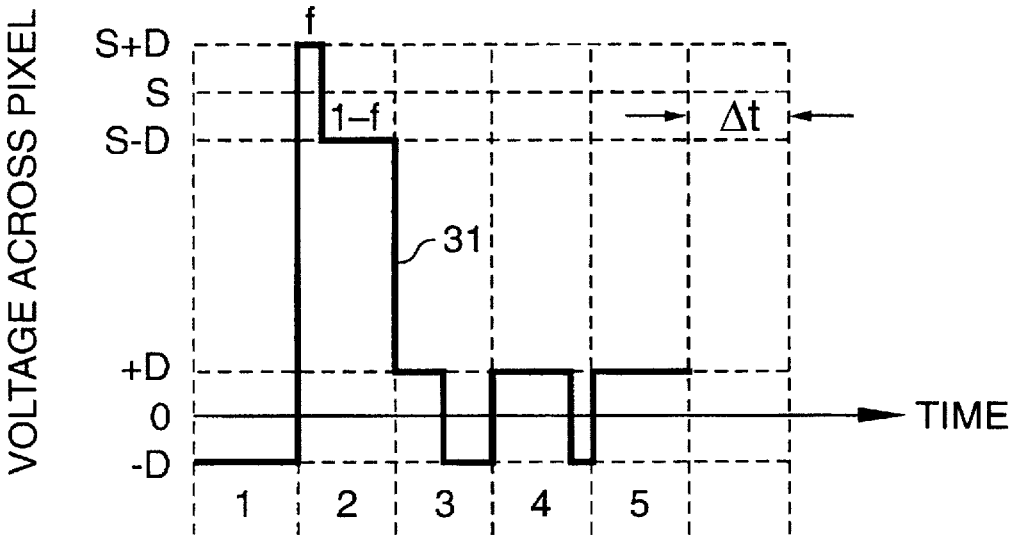
FIG. 3A (Prior Art)
Figure 4:
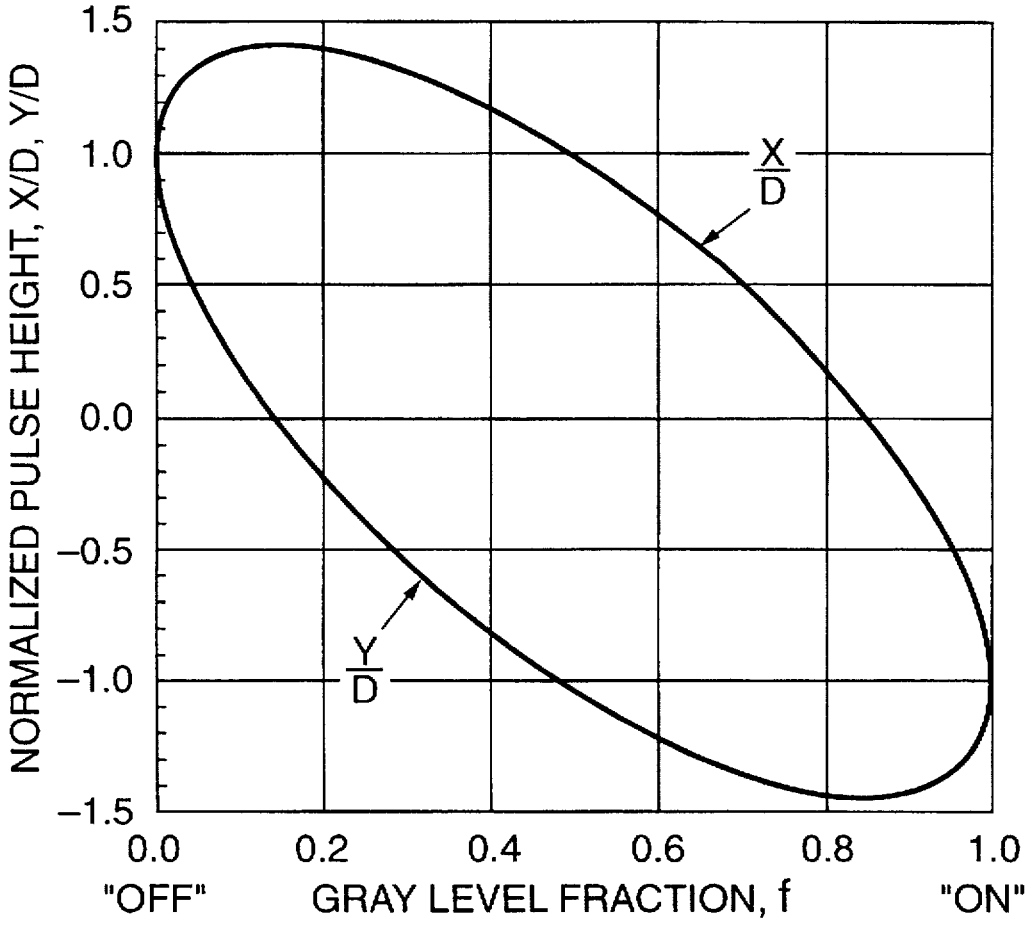
FIG. 4 is a graph of the normalized column voltages, plotted as a function of the gray level fraction computed according to the pulse-height modulation method of this invention in the split interval, standard addressing mode.

In the prior art "pulse-width" gray scale addressing system (FIG. 3A), a column signal of amplitude −D, corresponding to an "on" pixel, is applied for only a fraction, f, of the row select time interval, Δt, and a column signal of an amplitude of +D, corresponding to an "off" pixel, is applied for the remaining fraction, 1−f. During the row select time interval, Δt, the amplitude of the signal "seen" by the pixel is S+D for the fraction, f, and S−D for the remaining portion, 1−f, of the time interval (FIG. 3A). Since the pixel sees a signal amplitude of either +D or −D over the remaining time intervals of the frame, the rms voltage across the pixel averaged over one frame period is intermediate between the rms voltage when the pixel is "on" and the rms voltage when the pixel is "off". The result is a pixel response in an intermediate optical state of transmittance or gray level. The fraction, f, also describes the relative position of the intermediate pixel voltage between the root mean square "off" pixel voltage and the root mean square "on" pixel voltage, that is, f is the gray level fraction varying between zero and 1 (FIG. 4).

It will be noted in FIG. 3A that the pulses become narrower and the high frequency content of the column drive signals increases with the number of gray levels. Because the higher frequencies are removed by the inherent low-pass RC filter action of the LCD panel, it is very difficult to realize more than about four to seven real gray levels on a display with the "pulse-width" modulation method.

"Swift" Addressing

The aforementioned U.S. Patent application describes a "Swift" addressing system for LCD panels, which does not require the single, high amplitude row select pulse that causes frame response in standard addressing. The row or first signals of Swift addressing are characterized by:

1. A common frame period, T, and the signals are preferably orthonormal;
2. More than one row select pulse per frame period, pulses preferably uniformly distributed over the frame period; and
3. Signals phased in such a way that a plurality of rows are "selected" (i.e., receive non-zero voltage) at any one time.

The most general kind of functions satisfying the above Swift criteria are the continuous functions where the voltage levels are a continuous function of time. An example of such functions would be the orthonormal sine and cosine functions of various frequencies. For these types of functions there is no characteristic time interval and the sampling must be done on a continuous basis. These types of functions are well suited for analog implementation of Swift addressing.

Another class of functions that is particularly amenable for digital implementation of Swift addressing are the orthonormal bilevel (two-level) functions which alternate over discrete time intervals, Δt, between two constant, non-zero voltage levels, preferably of the same magnitude but opposite sign. These functions can be represented by Hadamard matrices, which are square orthogonal matrices with the elements −1 and +1. The characteristic time interval, Δt, of the Swift function is the frame period T divided by the order of the Hadamard matrix. The order of any Hadamard matrix is divisible by 4, and thus can be represented by 4t, where t is a positive integer. Thus the characteristic time interval Δt is given Δt=T/(4t).

Walsh functions are a subset of Hadamard matrices whose order is a power 2, i.e., there are $2^s$ time intervals where s is an integer, such that $2^{s-1}<N\leqq 2^s$. The characteristic time interval in this case is $\Delta t=T/2^s$. Walsh functions are particularly useful for Swift addressing because fast Walsh transforms (FWT) are known which can considerably simplify the number of computations required to generate the column or second signals.

Other subsets of the Hadamard matrices that are particularly useful for Swift addressing are those subsets constructed from maximal length pseudo random binary sequences. Except for one row and column, these are circulant matrices in which a new row function can be generated from a previous one simply by phase shifting it by one time interval. Like Walsh functions, this special type of Hadamard matrix has an order that is a power of 2, and thus the characteristic time interval is also given by $\Delta t=T/2^s$. Almost circulant Hadamard matrices can also be generated from Legndre sequences that have matrix orders that are given by (p+1)=4t, where p is a prime number In this case the characteristic time interval would be given by Δt=T/(p+1). Almost circulant Hadamard matrices can also be generated from twin-prime sequences which have matrix orders of p(p+2)+1, where p and p+2 are both prime numbers. Here the characteristic time interval would be given by Δt=T/[p(p+2)+1].

Another class of Swift functions includes the multilevel orthonormal functions where the row voltage can attain three or more different voltage levels during discrete time intervals. Examples of these functions are the Haar functions and the slant functions which are both well known in digital signal processing for image transmission. Other multilevel functions can be derived by appropriately combining other orthonormal function sets. An example of this would be the mixed Walsh-Haar series. Multilevel pseudo-random sequences are also known.

Three-level Swift functions can be generated from the two-level Hadamard functions by expanding the size of the matrix and adding time intervals where the voltage level is zero instead of ±1 in such a way that the matrix remains orthogonal and the row is selected at uniform times over the frame period. This method is referred to as the sparse matrix expansion. This expansion can simplify the hardware implementation of Swift addressing because the product of information element and row voltage need not be taken over those intervals where the row voltage is zero.

For example, a 4×4 Walsh matrix could be transformed into an 8×8 Swift matrix by inserting a column of zeros after each Walsh column for the upper half and repeating this configuration for the lower half by cyclically shifting it by one column.

Larger matrices can be similarly generated by adding more columns of zeros between the Hadamard columns and appending an equal number of cyclically shifted versions to the bottom of the matrix. For example, adding two columns of zeros after each Walsh column of the 4×4 matrix and appending two shifted matrices onto the bottom results in a 12×12 Swift matrix.

It should be apparent that this operation preserves the orthonormality condition as well as uniformly distributes the selection intervals throughout the frame period, as per Swift conditions 1, 2 and 3, above. The characteristic time interval for these types of Swift function is the frame period divided by the order of the matrix (i.e. the number of matrix columns).

Even more Swift row functions can be generated from the above mentioned ones by interchanging matrix rows, negating matrix rows (i.e. , multiplying them by −1), interchanging matrix columns, negating matrix columns or any possible combination of all four of these operations.

For Swift row addressing signals derived from other sequences the characteristic time interval Δt is defined as the frame period divided by the number of elements in the sequence. The Swift column voltage at any time interval, Δt, is proportional to the sum of the products of the row voltages at that time interval and the desired information states (+1 for "off" or −1 for "on") of the corresponding pixels at the intersection of that column and those rows. The Swift column voltages thus can assume many values, not just the two, +D and −D, which characterize standard addressing.

Although prior art pulse-width modulation can be applied to Swift addressing to achieve gray levels, it suffers from the same problem, namely that the narrower pulses are too severely attenuated by the RC low pass filter action of the LCD panel to ever reach the pixel. The end result is that an insufficient number of gray levels are available on the display to portray images to the desired fidelity.

PULSE HEIGHT MODULATION

In order to provide a substantially greater number of displayable gray levels without the concomitant increase in high frequency content of the column drive signals, the present invention provides methods of and moans for applying to the display columns variable voltage levels that are constant over time intervals substantially longer than the shortest time intervals that would have been utilized in generating the same number of gray levels by pulse-width modulation techniques. The methods and means of this invention are used to determine the values of the column voltage levels and their timing in order to insure that each pixel of the display will adopt its predetermined gray shade without interacting with the gray levels of other pixels of the display.

The gray level methods and apparatus of this invention encompass two different modes to determine the values of column voltage levels and their timings in order to render the desired gray levels for each pixel on the display. In the split interval mode, two column voltage levels are computed for each characteristic time interval Δt. In the full interval mode, one column voltage level is computed for each characteristic time interval and at least one row is designated as a "virtual" or phantom row across whose virtual pixels voltages are determined by the information states or elements of all the other pixels in its column.

Split Interval Mode—Standard Addressing

In the split interval mode (FIGS. 1, 3B, 5B) the characteristic time interval, Δt, is divided into two subintervals, Δs and a different column signal or voltage is applied over each subinterval. Preferably the two subintervals are of equal length to maintain the lowest possible frequency content of the column signal.

For the split interval mode, the amplitudes or voltage levels of the column signals, X and Y, are chosen to provide the same rms voltage across the pixels during each time interval, Δt, that would have been applied if pulse-width modulation had been used. The resulting rms voltage across the pixels averaged over the entire frame period, T, will also be the same as if pulse-width modulation had been used and, hence, the gray levels will be the same.

The X and Y column voltages according to the method of this invention will satisfy the two conditions that the rms pixel voltages during both the selected and non-selected intervals match the rms pixel voltages during the corresponding intervals according to the pulse-width modulated method if they are determined by the equations:

$$X = D(1 - 2f + 2\sqrt{f(1-f)}),$$

$$Y = D(1 - 2f - 2\sqrt{f(1-f)}).$$

Figure 5A:
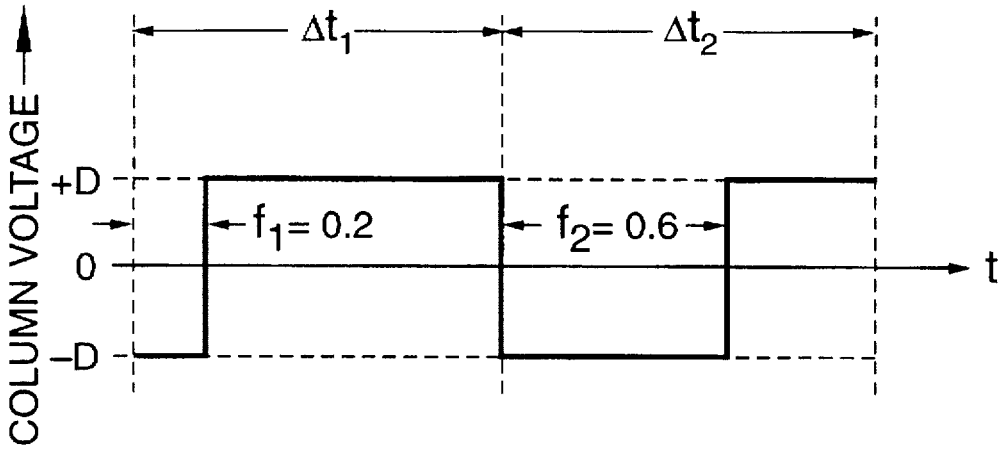
FIG. 5A (Prior Art)

FIGS. 5A and 5D compare a portion of a pulse-width modulated column signal with the pulse-height modulated column signal of this invention. The values of the X and Y column voltages are obtained from the graph of FIG. 4 which plots the normalized column voltages, X/D and Y/D, as a function of the gray level fraction f. Every gray level fraction, f, is associated with two voltage levels, X and Y, except for the special cases where f=0 ("off") and f−1 ("on") in which X=Y (FIG. 4). Voltage X is arbitrarily applied over the first time subinterval, $\Delta s_1$, and Y is applied over the second time subinterval, $\Delta s_2$.

In operation according to the method of this invention in the standard, split interval mode, the rows of display 12 (FIG. 1) defined by row electrodes 22 are selected sequentially by the application of the pulses of amplitude S of row signals 28. During the first time interval, Δt, that the uppermost row in FIG. 1 is being selected, column signals 30, of amplitudes X and Y (both equal to D), related to the desired gray level of the uppermost left pixel of display 12 are respectively applied to the left most column during the first two subintervals, Δs. The result is that the voltage that the upper, left pixel denoted by reference numeral $\mathbf{26_5}$ sees has a pulse height of S−D during the first time interval, and, therefore is "off" or dark.

Coincidentally, as a row select signal is applied to each successive row in the display during successive time intervals, the appropriate column signals X, Y related to the desired gray levels of the respective pixels, will be applied during successive subintervals, Δs, to the respective columns. In the example of FIG. 1, the desired gray levels vary from 1 for "on" or bright to 5 for "off" or dark, with 2, 3 and 4 representing intermediate gray levels. The corresponding values of "f" (FIG. 4) are respectively 1, 0.75, 0.5, 0.25 and 0. The shading and the subscripts for pixels 26 in the two left columns of FIG. 1 are representative of the desired gray levels resulting from the generation and application of row and column signals of proper magnitude and timing according to the above described method.

FIG. 3B compares a portion of the idealized pixel voltage waveform, transformed according to the gray level method of this invention from a corresponding portion of the pixel voltage waveform of the pulse-width modulated gray level method of the prior art, with the latter shown in FIG. 3A.

In the example given above the number of time subintervals in the frame period and hence the frequency content of the column signals is twice that of the standard LCD drive without gray levels. Even though most of these frequencies are low enough to be passed by the RC filter action of the LCD, under some circumstances it may be advantageous to halve such frequency by doubling the width of the time subintervals and using two frame periods to supply the required voltage levels to the display. For example, the X and Y levels could be supplied alternately to the columns, as indicated above or alternatively, all of the X voltage levels and all of the Y voltage levels could be alternatively applied during time intervals of successive frame periods. In such cases the frequency content of the column signals would be the same as in standard LCD drive methods without gray levels.

Split Interval Mode—Swift Addressing

As mentioned above, one method to achieve gray levels with Swift addressing is to employ a pulse-width modulation technique. Using this technique the characteristic time interval $\Delta t$ is broken up into unequal subintervals, $\Delta s$, whose lengths successively increase by powers of two and where the voltage level in each subinterval is determined by the information states of the respective bits in the gray level "words" for all pixels in the display column.

Figure 6A:
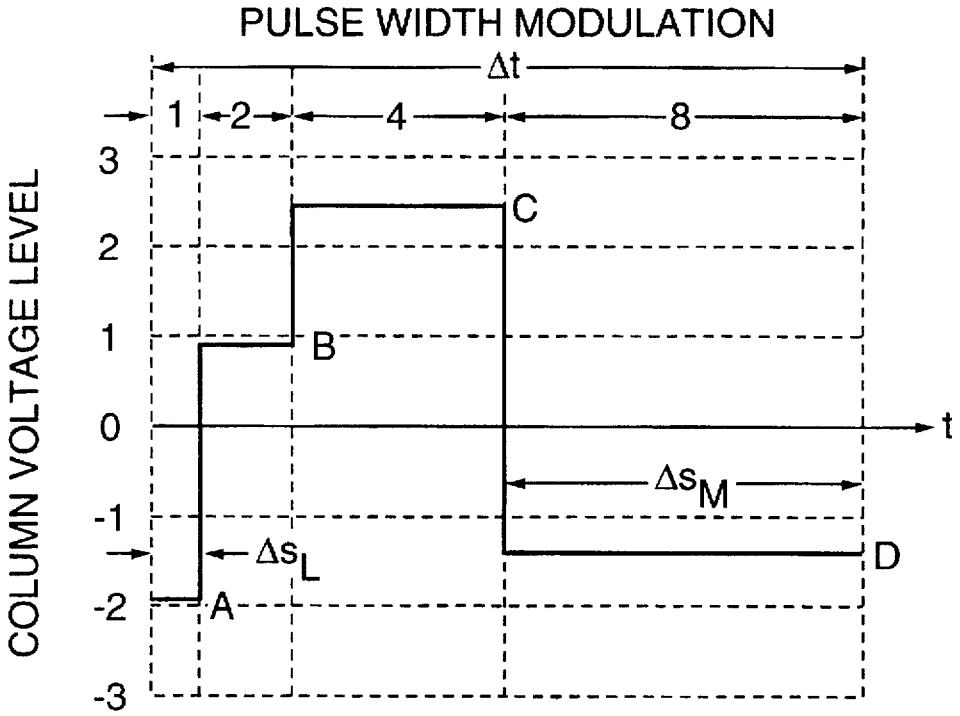
FIGS. 6A and 6B are schematic representations of portions of idealized column signals respectively comparing those of the pulse-width modulation method (6A) with the method of this invention, (6B) in the split interval, "Swift" addressing mode.

For example, FIG. 6A illustrates the column voltage levels in one characteristic time interval for 4 bits of gray scale, corresponding to 16 gray levels. (There are of course many such time intervals in the frame period, and each one will generally have a different set of column voltage levels.) In the time interval illustrated in FIG. 6A, the four voltage levels are symbolically represented by A, B, C, and D, where A corresponds to the least significant gray bit (LSB) and D corresponds to the most significant gray bit (MSB). The narrowest time subinterval corresponding to LSB, $\Delta s_L$, has many high frequency components which reduce its effectiveness in determining a gray level because of the inherent RC filtering action of the LCD panel.

Figure 6B:
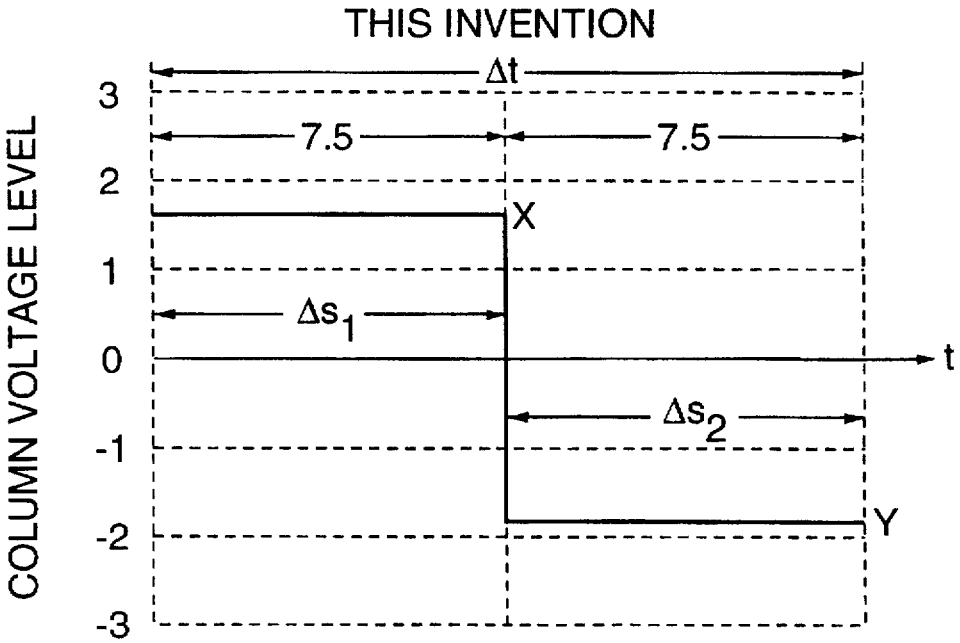

The gray level method of this invention avoids such high frequency components by employing a column signal as illustrated in FIG. 6B which has only two voltage levels, X and Y, distributed over much longer time subintervals, $\Delta s$.

Similar to the procedure used for standard addressing, the values of X and Y are based on the column signal that would have been produced had the pulse-width modulation system been used.

Figure 8:
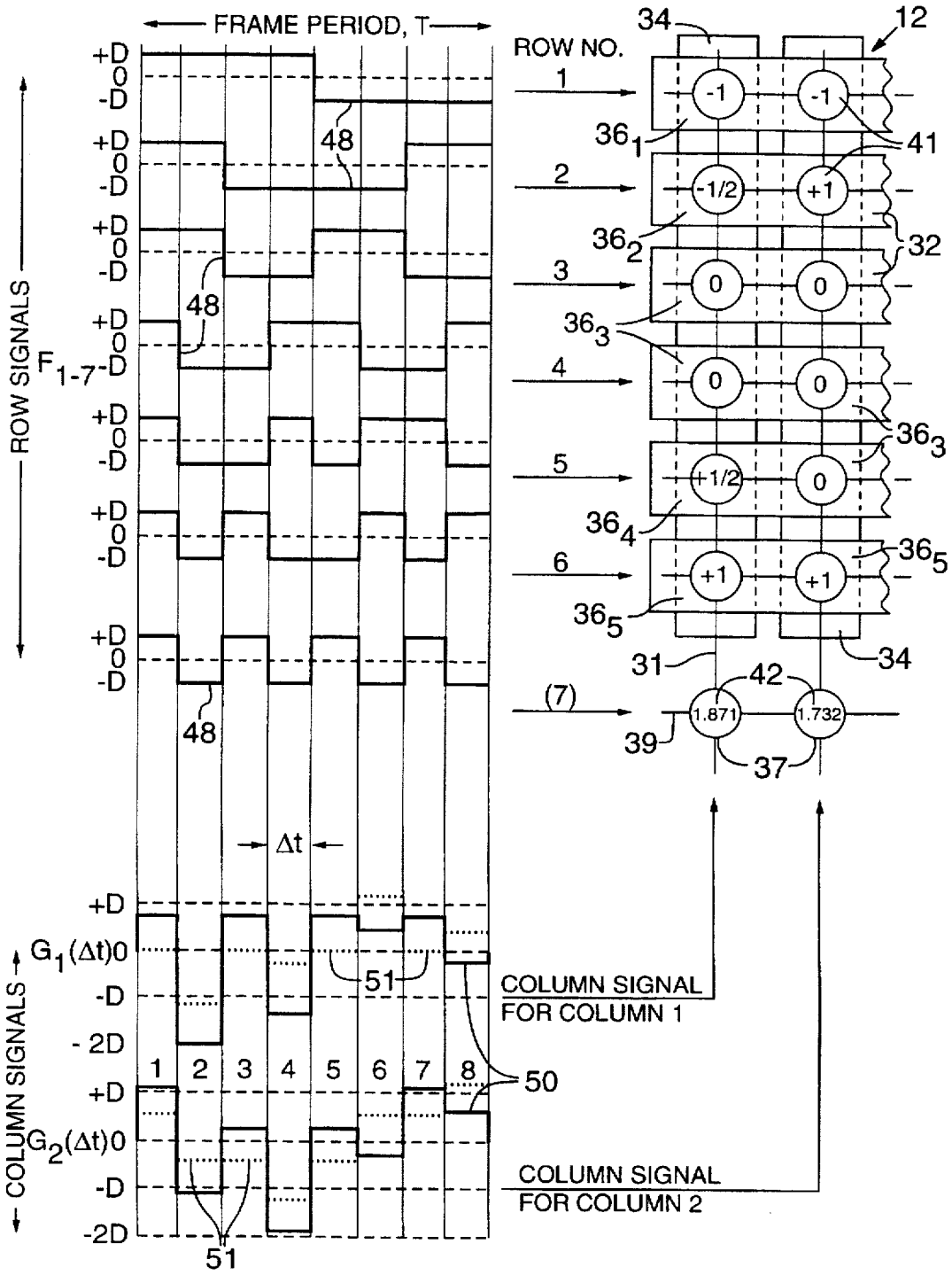
FIG. 8 is a view similar to FIG. 7 but with a schematic representation of idealized signals generated and applied according to the method of this invention in the full interval, "Swift" addressing, mode.

In one implementation of Swift addressing, the display rows are driven with bilevel Swift signals during characteristic time intervals, $\Delta t$, where the row voltage levels are either +D or −D but are never zero (See FIG. 8 for example). The resulting pixel voltage is the difference between the column and row voltages, so in determining the rms pixel voltage over the characteristic time interval two cases must be considered: one when the row level is −D and the other when the row level is +D.

In order that the rms pixel voltage of the gray level method of this invention illustrated in FIG. 6B, be the same over the characteristic time interval, $\Delta t$, as the pulse-width modulated method of FIG. 6A, the column voltages, X and Y of the former are calculated by:

$$X=\frac{1}{2}\,[p+\sqrt{2q-p^2}\,],$$

and

-continued $$Y=\frac{1}{2}\,[p-\sqrt{2q-p^2}\,],$$

where p and q are related to A, B, C, and D by:

$$p=\frac{2}{15}\,\{A+2B+4C+8D\},$$

$$q=\frac{2}{15}\,\{A^2+2B^2+4C^2+8D^2\}.$$

For the example illustrated in FIGS. 6A and 6B, A=−1.888, B=0.944, C=2.360 and D=−1.416. From the above equations, p=−0.252 and q=5.822 and, finally, X=1.576 and Y=−1.828. The above equations can easily be extended to include more gray levels. For example, for 8 bits of gray scale, i.e. 256 gray levels, E, F, G and H terms would be added to the above equations with respective multipliers of 16, 32, 64 and 128, and the fraction 2/15 changed to 2/255.

A more general statement of the above equations for determining p and q which would accommodate varying numbers of gray levels is:

$$p=\frac{2}{2^n-1}\sum_{g=1}^{n}2^{g-1}G_g,$$

and $$q=\frac{2}{2^n-1}\sum_{g=1}^{n}2^{g-1}G_g^2,$$

where n is the number of gray bits in the gray level word, g is the position of the gray bit in the gray level word, and $G_g$ is the column voltage level for the $g^{th}$ gray bit.

In the case of 16 gray levels illustrated in FIGS. 6A and 6B, the narrowest pulse width in the column signal of this invention (FIG. 6B) is 7.5 times wider than the narrowest pulse in the pulse-width modulation method of FIG. 6A, resulting in 7.5 times lower frequency components in the column signal and much less filtering by the ICD panel. This factor for the general case of n bits oft gray scale is equal to $(2^n-1)/2$, and would be 127.5 for the example of 8 gray bits or 256 gray levels.

As in the standard addressing, split interval mode, row signals which are independent of the information to be displayed are applied to the row electrodes coincidentally with the application of column signals representative of such information to the column electrodes, resulting in the pixels displaying the desired information in the appropriate gray levels.

Full Interval Mode—Standard Addressing

One of the characteristics of the "Swift" addressing method described in applicants' pending application, U.S. Ser. No. 678,736, is a provision of an information matrix (generally designated 31 in FIGS. 7, 8). Matrix 31 is made up of pixel information elements 41 which correspond one-to-one to the matrix of pixels 36 shown in FIGS. 7 and 8 at the intersections of rows 32 and columns 34. The pixel information element 41 corresponding to the pixel 36 at each of said intersections designates the desired "state" or gray level of the associated pixel.

In the full interval mode of the gray level addressing system of this invention, the values, I, of pixel information elements 41 may vary between −1 for "on" (or, for example, bright transmittance) to +1 for "off" (or, for example, dark transmittance). Any value between those lower and upper limits designates a gray level which it is desired that the associated pixel display.

In addition to the pixel information elements associated with the "real" rows 32 and column 34 defining "real" pixels 36, the information matrix 31 of this invention for operating in the full interval mode requires at least one "virtual" or phantom row 39 (FIGS. 7, 8) which crosses or overlaps extensions of columns 34 to provide virtual pixels 37.

With every virtual pixel 37 there is associated a virtual information element 42 whose value, V, is determined by the values, I, of pixel information elements 41 of all the other pixels in that column. For the case of one virtual row, the value of the virtual information element, V, associated with each column, in determined from:

$$V=\pm\sqrt{N-\sum_{i=1}^{N} I_i^2},$$

where N is the number of rows in the display, and $I_i$ are the pixel information elements of the real row.

From the above equation it can be seen that the virtual information element is zero when there are no pixels with gray levels in the column.

The column signals depend upon the information to be displayed. In the full interval mode with standard addressing the column signal at any time is proportional to the value of the information element of the selected row, real or virtual (I or V). More precisely, the column signal, G, for each column at the time interval, Δt, when a real row is selected is given by:

$$G=DI,$$

and during each time interval that a virtual row is selected, the amplitude of said column signal G is determined by:

$$G=DV.$$

When the gray level method of this invention operating in the full interval mode is applied to displays using standard row addressing signals (FIG. 7) the characteristic time interval, Δt, is the frame period, T, divided by the sum of the number of real display rows, N, and the number of virtual display rows, n, thus, Δt=T/(N+n).

Figure 7:
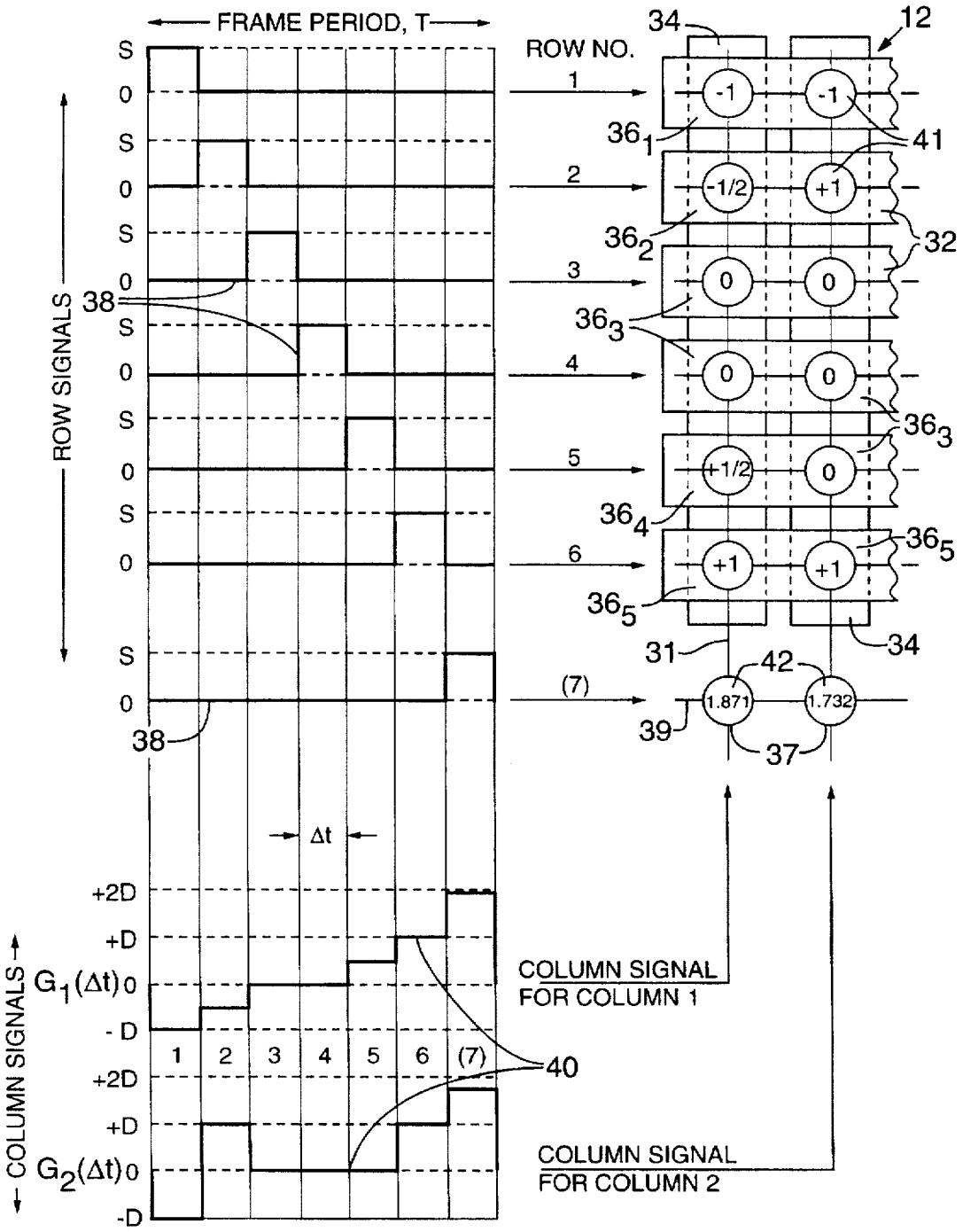
FIG. 7 is a semi-diagrammatic plan view similar to FIG. 1 of a portion of an LCD panel with a schematic representation of idealized row and column signals generated and applied according to the method of this invention in the full interval, standard addressing mode and with a portion of a matrix of information elements superimposed over the matrix of pixels.

In the FIG. 7 example the display has 6 real rows 32, numbered 1–6 and one virtual row indicated by (7). The row signals are sequential block functions that have zero level everywhere except during the row select interval where the level is S. The rms value of these functions is D.

The desired gray levels of the pixels 36 in FIG. 7 are represented by the pixel information elements 41. In column 1 those elements are −1 in row 1 representing "on" or white, −½ representing light gray in row 2, 0 representing medium gray in rows 3 and 4, +½ representing dark gray in row 5 and +1 representing an "off" or black pixel at row 6. The corresponding shades or levels of gray to be displayed at pixels 36 in column 1 are represented by the subscripts, 1–5. The information elements in column 2 correspondingly represent the white, black and medium gray shade for the pixels 36 in that column.

From those examples the virtual information elements 42 for each of the columns 1 and 2 may be calculated according to the previous equations as:

for column 1, $V=\sqrt{6-2.5}=\sqrt{3.5}=1.871$, and for column 2, $V=\sqrt{6-3}=\sqrt{3}=1.732$.

The column signal $G_1$, for the first column over the 7 time intervals of the frame period is therefore −D, −½D, 0, 0, +½D, +D, and 1.871D. For column 2 the column signal $G_2$, over the 7 time intervals is −D, +D, 0, 0, 0 +D and 1.732D, respectively.

It will be noted that the amplitudes of the column signals in FIG. 7, normalized by D, are identical in value, sign, and sequence to the information elements of the respective pixels in the columns. The final time interval in the column signal is the adjustment term derived from the respective virtual information element that appropriately adjusts the rms voltage appearing across all the pixels in the column so that they will display the appropriate gray levels.

A simplified version of standard LCD addressing has been described for the sake of clarity. In the CD display industry it is common practice to periodically offset and invert both row and column signals in order to reduce the voltage swing requirement for the row driver electronics and to prevent net D.C. voltages from appearing across the pixels which could potentially damage the liquid crystal material. These measures affect neither the rms voltages appearing across the pixels nor their optical states. One skilled in the art will realize that these measures can be applied to the row and column signals of the present invention to achieve the same results.

Full Interval Mode—Swift Addressing

The concept of information elements associated with each pixel whose values vary between −1 for "on" and +1 for "off" with intermediate values designating intermediate states, or gray levels, can also be applied for the case of the full interval method used with Swift addressing. The concepts of virtual rows, virtual pixels and virtual information elements apply as well.

Swift addressing uses different row addressing waveforms than the sequentially pulsed row addressing waveforms of standard addressing. Like standard addressing waveforms, Swift row addressing waveforms form an orthonormal set, the difference is that each row is "selected", i.e. has a non-zero voltage applied to it, by pulses applied to it a plurality of times during a frame period and more than one row is selected at any one time.

In the full interval mode with Swift addressing the amplitude of the column signal at any time, t, is proportional to the sum of the products of the real and virtual information elements of the pixels in that column and the amplitude or level of the row signal associated with that pixel at that time, t. The signal for each column at any time t, G(t), equals:

$$\frac{1}{\sqrt{N}}\sum_{i=1}^{N} I_iF_i$$

$$+$$

$$\frac{1}{\sqrt{N}}\sum_{k=N+1}^{N+n} V_kF_k$$

where N is the number of multiplexed real rows, $I_i$ is the pixel information element at a particular row, $F_i$ is the amplitude of the row signal applied to that row at said time. $V_k$ is the information element at a particular virtual row, and $F_k$ is the amplitude of the virtual first signal, i.e., the row signal associated with that virtual first electrode or row at that time.

In this equation, the root-mean-square values of the row signals are equal to D. The first or "dot product" term is the sum, taken over the N real rows of the display, of the products of the gray level information state, I, of a pixel and the voltage applied to its row. The second or "adjustment" term is the sum, taken over the n virtual rows of the display, of the products of the virtual information elements, V, and their corresponding virtual row voltages. The second term, is added to the first in order to adjust the column signal to obtain the proper rms voltage across the pixels.

FIG. 8 shows the same display and matrix 31 with the same information pattern as in the example of FIG. 7, except that Swift row addressing signals 48 are applied to the six real matrix rows 32. In this example, bilevel Swift row signals based on the second through seventh sequency ordered Walsh functions are applied to the six real display rows, but other Swift row functions would be equally applicable. The virtual display row 39 (7) is associated with the eighth Walsh function. The amplitudes of the row signals are either +D or −D and are orthonormal to each other. In contrast to the previous example of FIG. 7, the row function for the virtual row 39 in FIG. 8 does not involve an additional characteristic time interval. This is because the Walsh functions are part of a complete or closed orthonormal set whereas the sequential block functions used in standard LCD addressing are part of an incomplete or open set.

For the full interval, Swift addressing system of FIG. 8, the virtual information elements 42 are computed as in the previous example, and have the same values since the desired display information pattern for pixels 36 is the same.

The amplitudes, G(Δt), of the column signals 50 for this operation are determined for each of the 8 time intervals, Δt, by calculating the first component related to the sum of the products of the amplitudes, ±D, of the row signals 48 and the pixel information elements 41 for each row 32 and adjusting that component by the adjustment term related to the product of the amplitude, ±D, of the row signal 48 associated with virtual row 39 and its virtual information elements 42, since only one virtual row is present.

The resulting column signals are shown in FIG. 8. The dotted line levels 51 indicate what the amplitudes of the column signals would be without the adjustment term. Such signals would not produce the rms voltage across the pixels 36 necessary to provide the desired optical state. The solid line levels 50 include the virtual row adjustment term and therefore give the proper rms voltages across the pixels. It is worth noting that in FIG. 7 the column signal adjustment term manifests itself as an additional time interval, whereas in FIG. 8 the adjustment is spread out over all the time intervals.

Of course a practical high information content display has many more than 6 multiplexed rows. The VGA resolution screens used in laptop and notebook computers, for example, typically have 240 multiplexed rows. The above example could easily be extended to this case by setting N at 240 in the various equations.

APPARATUS IMPLEMENTATION

General

Figure 9:
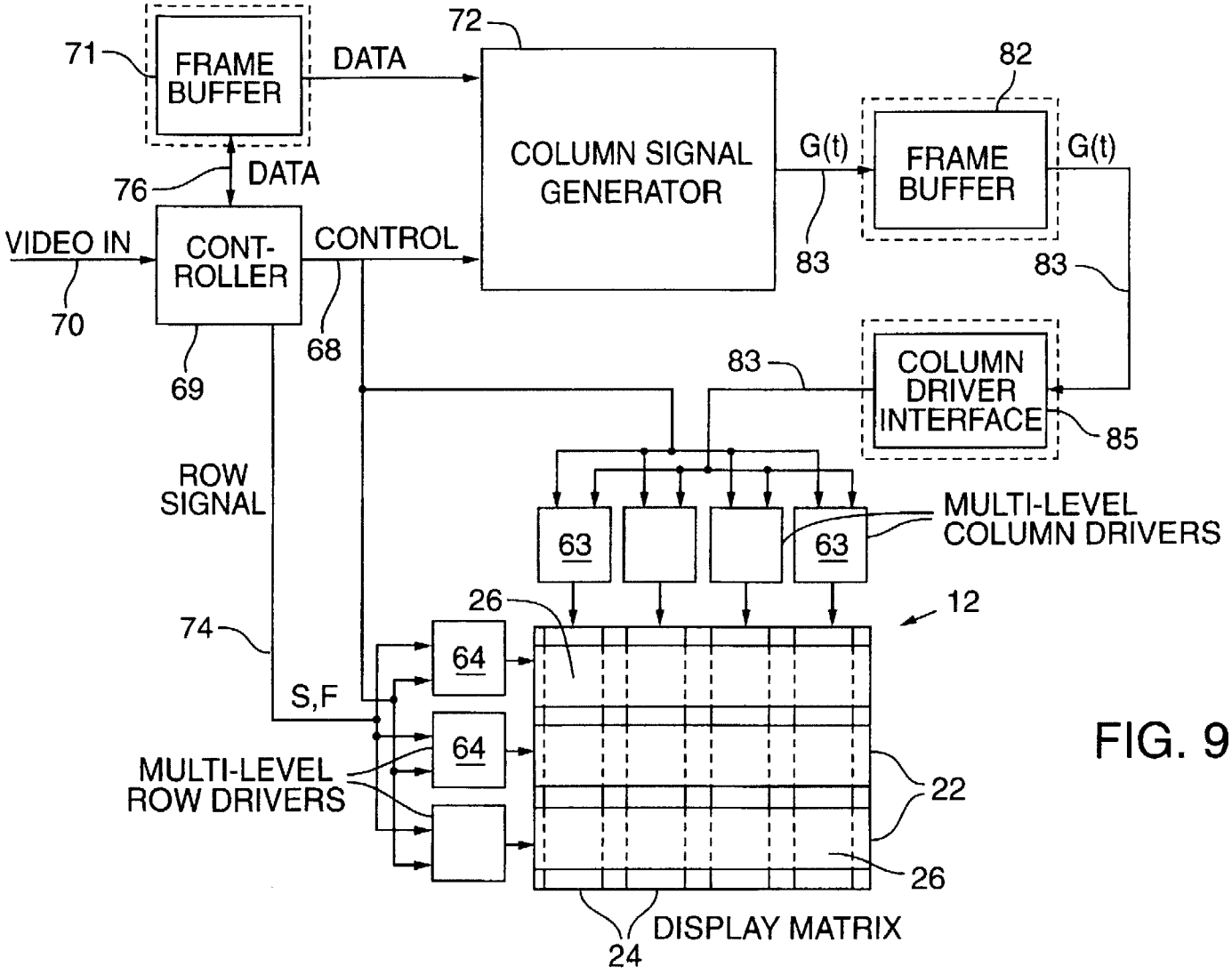
FIG. 9 is a generalized block diagram of apparatus for generating and applying signals to a passive flat panel display, such as is shown in FIG. 1, in accordance with this invention.

The pulse-height modulation method described above for providing gray level addressing may be implemented in apparatus for converting video signals into signals for addressing an LCD panel, as generally shown in FIG. 9. Video signals 70 comprising both information or data components and control or timing components are received by a controller 69. Most generally, the video signals may be either in digital representation, as is typical for a dedicated computer system, or in analog representation, as is typical for computer monitor outputs or television systems. In addition, the video signals typically are presented in a succession of horizontal or vertical rows of data, or scan lines, similar to the scan lines of a raster scanned CRT, although in a dedicated computer system, the video signals may be presented in an arbitrary progression.

Controller 69 formats the information or data components 76 and presents these components to a frame buffer 71 which receives and stores the data. Controller 69 also derives from the central components of video signals 70 control signals 68, which are presented to the other blocks in the apparatus to control the sequence of operations, including the addressing of the display panel 12.

The data stored in the frame buffer is presented to a column signal generator 72 which, under direction of control signals 68 computes column signals, G(t), in accordance with the split interval-standard, split interval-Swift, full interval-standard, or full interval-Swift modes of the method described previously. The column signals are presented to a second frame buffer 82, stored therein, and thereafter presented to a column driver interface 85, which converts them to signals compatible with multi-level column drivers 63. The column drivers apply the converted column signals to the column electrodes 24 of the display matrix 12.

Meanwhile, controller 69 has generated and presents row signals, S or F, to the row drivers 64 which, under direction of control signals 68 provided by the controller, receive the row signals and apply them to the row electrodes 22 of the display matrix 12. The row signals are independent of the data to be displayed, and depend on the particular method implemented. Row signals include the block pulse functions, S, typical of standard addressing, or Swift functions, F, as described previously for Swift addressing. The coincidence of the row signals on the row electrodes and the column signals on the column electrodes cause the display matrix to display the desired gray level image represented by the information components of the video signals.

In general, the controller 69, frame buffers 71, 82, and column signal generator 72 are comprised of digital circuitry, although analog circuitry may be used. Generally, column drivers 63 are capable of delivering at least 3 distinct levels of signals to the column electrodes, or more commonly at least 8 distinct levels, whereas the row drivers 64 are generally capable of delivering at least 2 distinct levels of signals. Depending on the particular mode of the method that is implemented, some of the blocks shown in FIG. 9 may not be necessary. For example, either or both of the frame buffers may not be necessary, as in the split and full interval, standard mode, when not implementing a split screen system.

In the general embodiment of the apparatus of this invention as well as those specific to the different modes, controller 69 (FIG. 10) is comprised of three blocks or components, for data formatting 53, for control and timing signal generation 54, and for row signal generation 73. Data formatting block 53 receives the information or data components 76 of the video signals and presents these data to frame buffer 71. In some embodiments of the split and full interval, Swift addressing modes, the data may undergo a predetermined sequence of inversion to simplify the architecture of other parts of the apparatus. This data inversion is accounted for by the controller 69 where the row signals corresponding to the inverted data are similarly inverted.

Control and timing signal generator or block 54 receives the control and timing components of the video signals and from these derives control or timing signals 68 necessary to sequence the apparatus through the proper series of operations. Row signal generator 73 provides the proper row signal to the row drivers 64 (FIG. 9) as determined by the particular mode in which the apparatus is operated.

Figure 11:
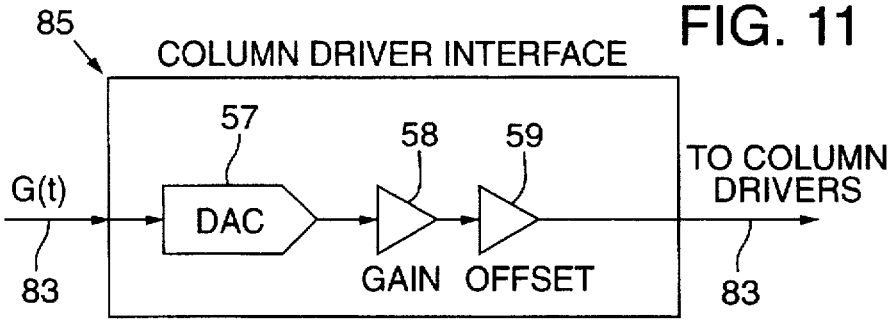
FIG. 11 is a block diagram of the column driver interface of the apparatus of FIG. 9.

In all the embodiments of the apparatus of this invention, column driver interface 85 (FIG. 11), where needed, translates the column signals, G(t), from the form in which it receives then into a form compatible with the column drivers 63. As shown in FIG. 11, typically digital column signals, G(t), from signal generator 72 are converted to analog signals by a digital-to-analog converter (DAC) 57, amplified by a gain block 58 and offset by an offsetting block 59. In some embodiments, column drivers 63 (FIG. 9, have a built-in digital interface, in which came the column signals may be directly interfaced to the column drivers. In such a case, the column driver supply voltages are selected to cause the column drivers to output scaled and offset signals represented by the digital column signals.

The representation of row 22 and column 24 electrodes in FIG. 9 is illustrative only; it will be understood that in practice the row 64 and column 63 drivers each apply signals to many electrodes, respectively.

Split Interval, Standard Addressing

Figure 10:
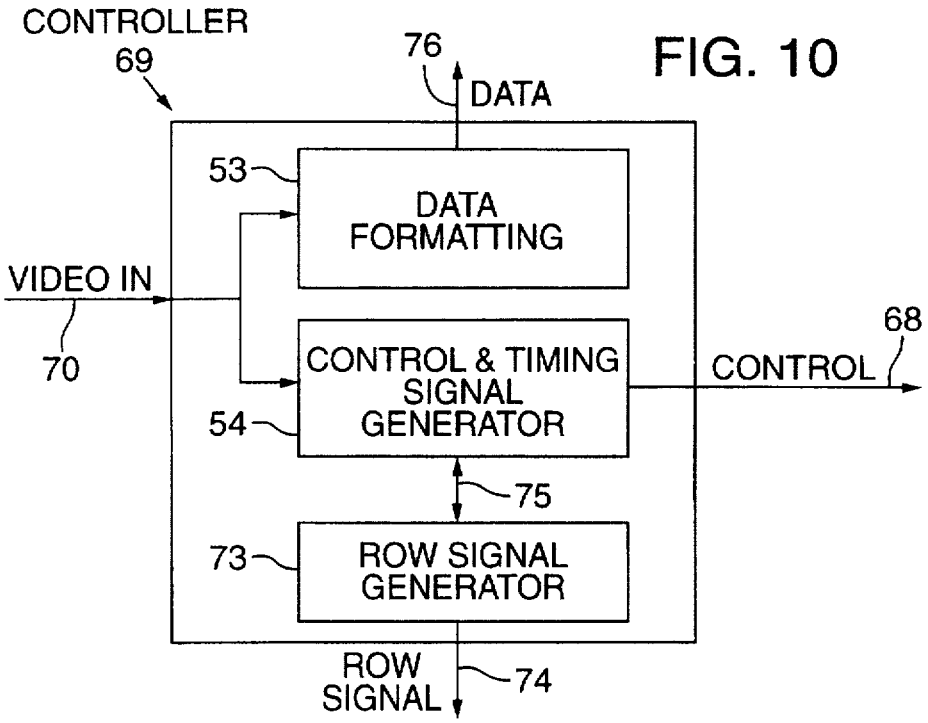
FIG. 10 is a block diagram of the controller of the apparatus of FIG. 9.
Figure 12:
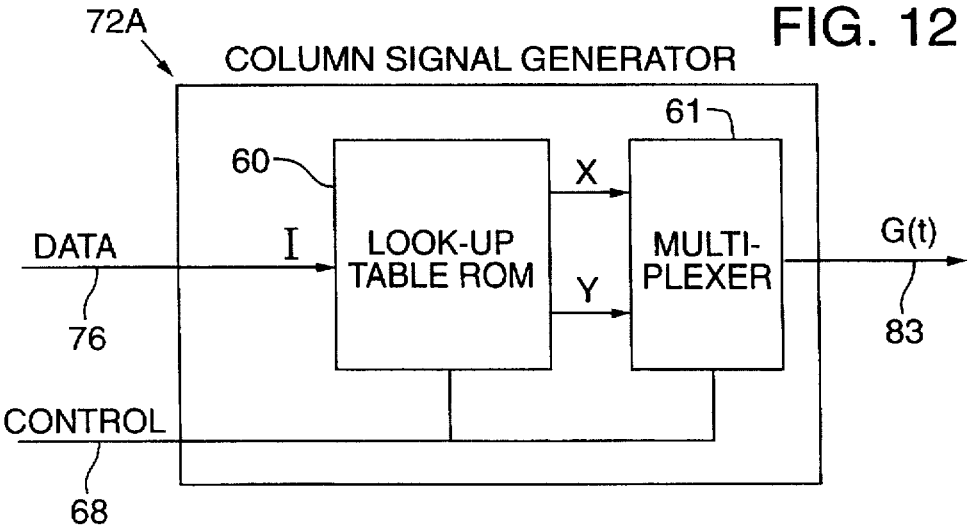
FIG. 12 is a block diagram of the column signal generator of the apparatus of FIG. 9 for operating in the split interval, standard addressing mode.

The apparatus for implementing the split interval, standard addressing mode is generally the same as described with respect to FIGS. 9–11, except for the composition of a column signal generator, designated 72A (FIG. 12).

Figure 3A:
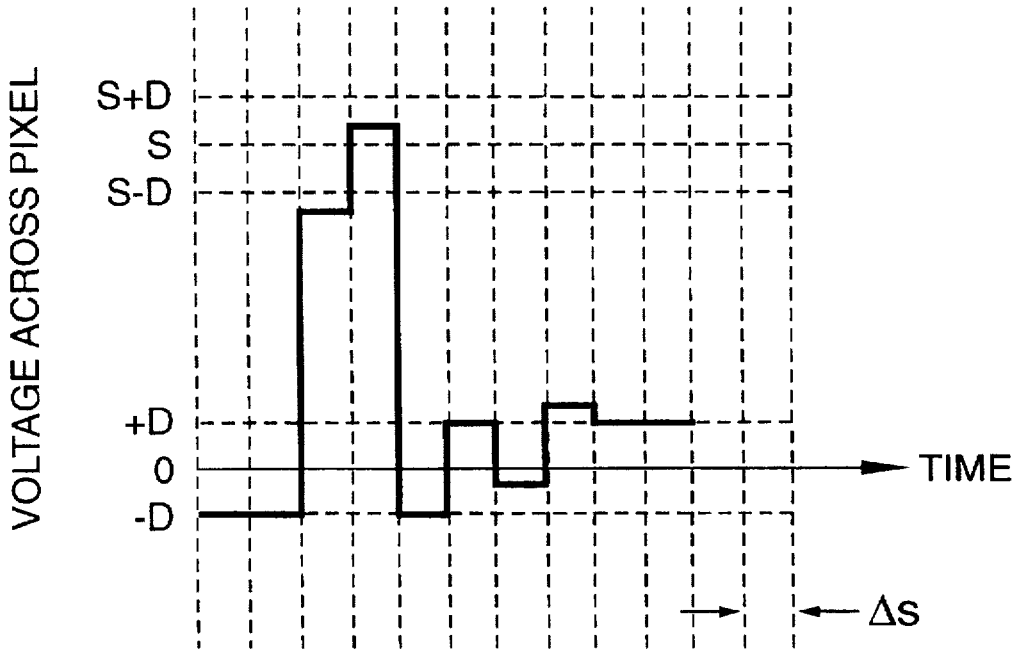
FIG. 3A (Prior Art)
Figure 5A:
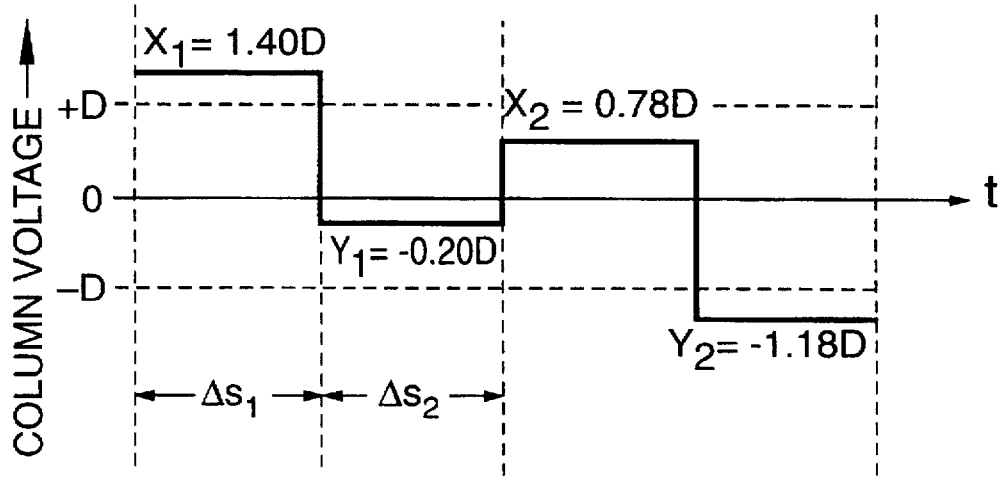
FIG. 5A (Prior Art)

In this embodiment, information or data components 76 of the video signal 70 are received from frame buffer 71 (or directly from the controller 69) by means for generating at least two column signals of different amplitudes or a "look up table" (LUT) 60 (FIG. 12) in the form of a read only memory (RON). LUT 60 contains two precalculated "X" and "Y" values for every possible datum, calculated in accordance with the split interval, standard addressing mode previously described with respect to FIGS. 3–5. Eack "X" value corresponds to the column signal during time subinterval $\Delta s_1$, and each "Y" value corresponds to the column signal during time subinterval $\Delta s_2$.

A multiplexor 61 (FIG. 12) in column signal generator 72A selects between the X and Y values during the two time subintervals and presents the resulting column signals to the inputs of multi-level column drivers 63 (FIG. 9) via connection 83. The column drivers queue the incoming signals and apply then in parallel to the column electrodes 24 of the display matrix 12.

In this embodiment, controller 69 generates the row signals in the form of the block pulse functions of height S, typical of standard addressing (FIG. 1). The row signals are presented to the inputs of row drivers 64 from controller 69, which drivers queue the row signals, then apply them in parallel to the row electrodes 22 of the display matrix 12 (FIG. 9).

Under the control of timing signals 68 to LUT 60 and multiplexers 61 (FIG. 12), row drivers 64 sequentially select or strobe the row electrodes of the display matrix during each characteristic time interval $\Delta t$, while the column drivers apply the X signals during time subinterval $\Delta s_1$, and Y signals during time subinterval $\Delta s_2$. The coincidence of application of the row and column signals causes the display matrix to display the desired gray level image.

Split Interval, Swift Addressing

Figure 13:
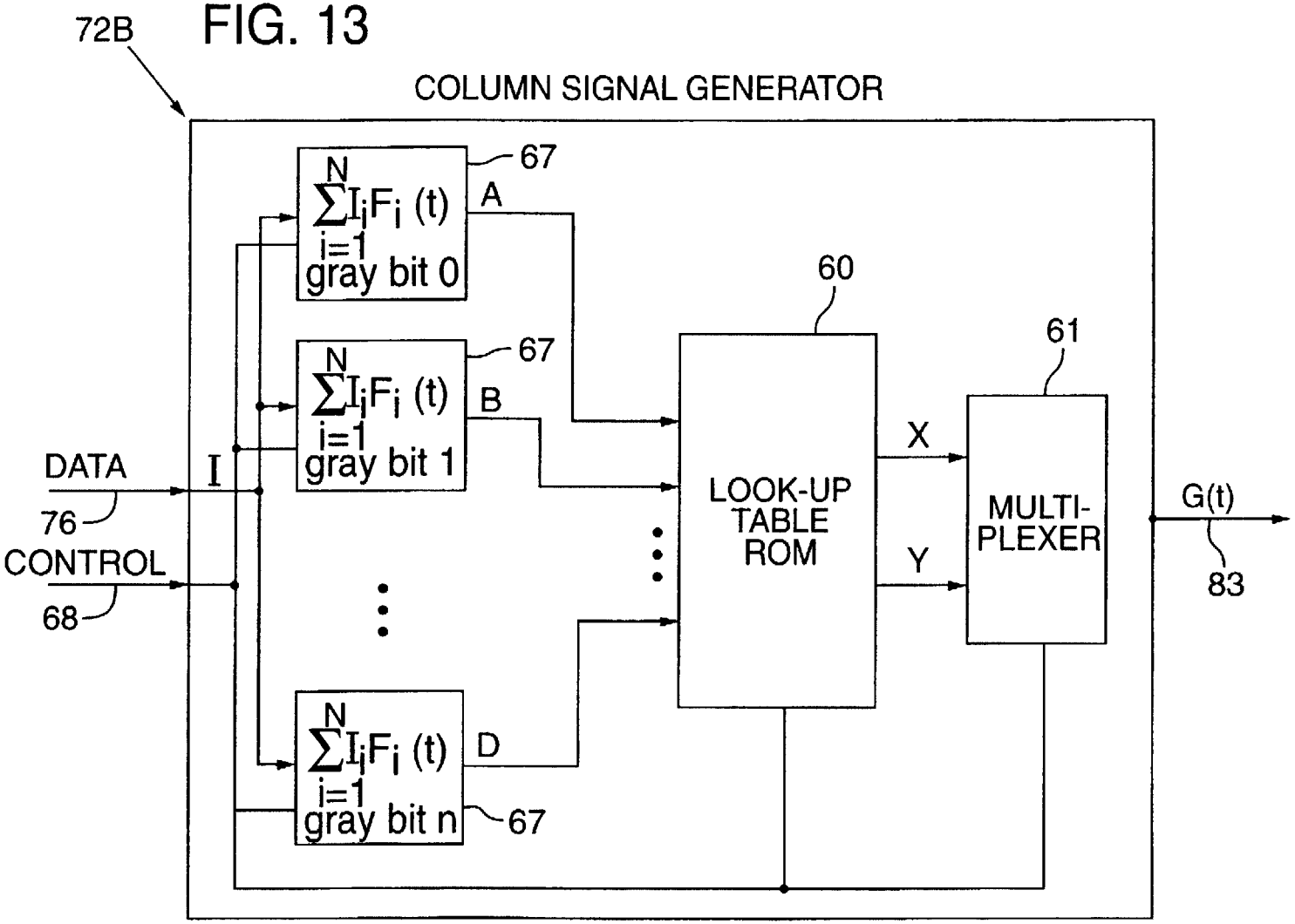
FIG. 13 is a block diagram of the column signal generator of the apparatus of FIG. 9 for operating in the split interval, Swift addressing mode.

In the apparatus for implementing the method of this invention operating in the split interval, Swift addressing mode, the column signal generator of FIG. 9 is modified as shown at 72B in FIG. 13. In this node, it is more convenient for the information or data 76 to arrive in a succession of vertical columns or scan lines, as opposed to the more conventional horizontal rows of data. Such vertical columns of data represent successive information vectors composed of information elements, I, and the conversion to vertical columns may take place in buffer 71 (FIG. 9).

The information components of the video signals 70 are routed to the data formatting block 53 (FIG. 10), which preferably performs an inversion to a predetermined selection of information or data elements, I. The data are then presented to the column signal generator 72B (FIG. 13), where they are used in accordance with the split interval, Swift addressing mode to generate column signals, G(t). Meanwhile, the row signal generator 73 of controller 69 generates and presents predetermined row signals in the form of Swift functions, F, as shown in FIG. 8, to the row drivers 64 (FIG. 9) and over line 75 to the control and timing signal generator 54 (FIG. 10) to generate control signals 68 therefrom.

In this embodiment, the column signal generator 72B includes a plurality of dot product generators or blocks 67 (FIG. 13) connected to LUT 60 and multiplexer 61. Generators 67 receive and perform a dot product of the information or data elements, I, with the Swift functions, F, under the direction of control signals 68 in accordance with the Swift addressing method. Each dot product generator 67 operates on one of the bit planes zero to n, comprising the information vector of elements, I, representing the data 76 received by signal generator 72B. As a result several dot products, "A", "B", . . . , "D" are computed, one for each bit plans of each information vector. The resulting dot products, A, B, . . . , D, are used to address LUT 60 which contains for all combinations of A, B, . . . , D two precalculated values X and Y calculated in accordance with the split interval, Swift addressing mode previously described.

As was the case with the split interval, standard addressing mode, the multiplexer 61 receives the X and Y values from look up table 60, selects the X values followed by the Y values and presents the resulting column signals to the frame buffer 82 (FIG. 9) via connecting means 83. The frame buffer receives and stores the column signals and presents them to the multi-level column drivers, which apply the X signals during time subinterval $\Delta s_1$ (FIG. 6B), and then the Y signals during time subinterval, $\Delta s_2$.

At the same time, the row drivers apply the Swift functions to the row electrodes 22 of the display matrix 12 for each characteristic time interval, $\Delta t$. As before, the coincidence of the applications of the row signals with the column signals causes the desired information from the video signal to be displayed on matrix 12.

Full Interval, Standard Addressing

Figure 14:
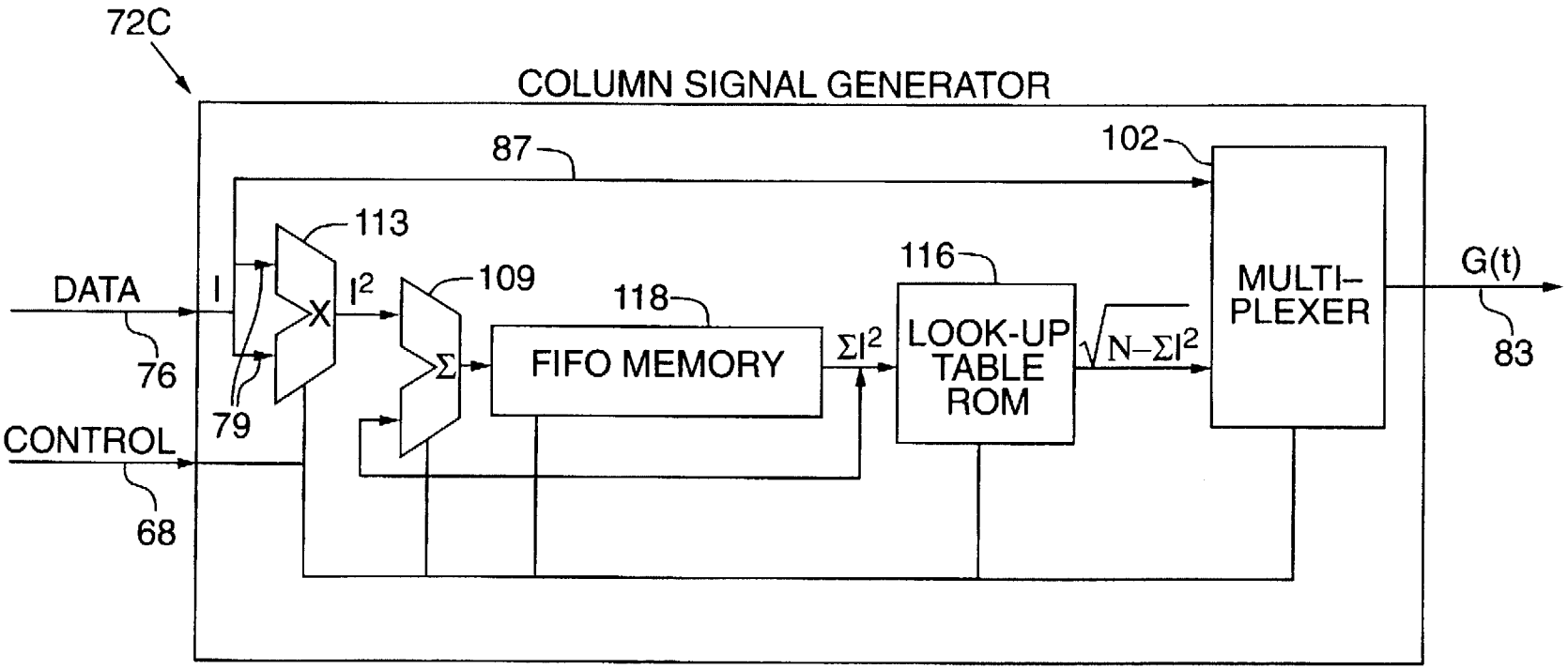
FIG. 14 is a block diagram of the column signal generator of the apparatus of FIG. 9 for operating in the full interval, standard addressing mode.

An embodiment of the apparatus for implementing the full interval, standard addressing mode is as shown in and described with respect to FIGS. 9–11 and includes the specific column signal generator 72C of FIG. 14. An described with respect to the mode illustrated in FIG. 7, this embodiment of the apparatus includes at least one additional characteristic time interval (7) and the virtual row(s) 39 with respect to which the virtual information elements 42 are generated and used to calculate an additional column signal.

In this example, the information or data is assumed to arrive in a succession of horizontal rows or scan lines, as is typical of the scanning lines of a raster scanned CRT. The data 76 is received by column signal generator 72C (FIG. 14), where it follows two paths. The first path 87 presents the data to one of the inputs of a multiplexer 102, and the second path 79 presents the data to both inputs of a squaring block or multiplier 113. Multiplier 113 performs a squaring operation to the information elements, I, of the incoming rows of data, and presents the squared data to one input of an adder 109. The other input of adder 109 receives previously-stored, squared data from the output of a first-in first-out (FIFO) memory 118, and the adder 109 performs a mumming operation of the present data and the stored data.

The resulting sum in presented to the input of FIFO memory 118, whore it is stored. As data is being received and squared the FIFO memory is shifted in such a way as to accumulate the squared data corresponding to each column of the display matrix. When all the rows of data for a frame period, T, have been processed, each location in the FIFO memory contains the sum of the squares of the information elements, I, of each column.

The FIFO memory 118 (FIG. 14) sequentially presents its contents to a square root block or look up table 116, which contains precalculated virtual information elements, V, corresponding to every sum of data, squared. LUT 116, in conjunction with multiplier 113, adder 109, and FIFO memory 118, all under the control of control signals 68, comprise means for generating the virtual information elements in accordance with the full interval, standard addressing mode previously described with respect to FIG. 7. LUT 116 presents the virtual information elements to the other input of multiplexer 102, which, under direction of control signals 68 from controller 69, selects between the incoming data or "real" information elements, I, and the calculated virtual information elements, V, resulting in the output to line 83 of column signals, G(t).

As was the case for the split interval, standard addressing apparatus, row signal generator 73 of controller 69 (FIGS. 9, 10) generates row signals in the form of the block pulse functions, S, typical of standard addressing. The row signals are presented to the inputs of row drivers 64, which queue the row signals and apply then to the row electrodes.

In this embodiment, row drivers 64 sequentially select or "strobe" each row 22 of the display matrix 12, while the column drivers 63 apply signals representative of the data corresponding to the selected or strobed row of the display matrix. After all the row electrodes have been strobed and during the additional time interval (7) when no "real" rows are strobed (FIG. 7), the calculated virtual information elements 42, are loaded into the column drivers and applied to the column electrodes of the display matrix. The coincidence of the row signals applied to the row electrodes with the column signals applied to the column electrodes causes the display of the information from the video signal in the desired gray level.

Full Interval, Swift Addressing

In the apparatus embodiment of the full interval Swift addressing mode, the column signal generator 72D (FIG. 15) is incorporated with the other components of FIGS. 9–11. As was the case for the split interval, Swift apparatus (FIG. 13), it is convenient to assume that the data 76 arrives in a succession of vertical columns of data, or vertical scan lines, and that the data formatting block 53 of the controller preferably performs an inversion to a predetermined selection of information or data elements, I.

In this embodiment (FIG. 15), data 76 is received from the controller, where it is presented to a correlation score or dot product generator or block 78 for computing a dot product, and to a multiplier-accumulator (MAC) 114. Dot product block 78 performs a dot product of the information vector represented by the information elements, I, of the incoming data with a vector comprising the value at a time Δt of each of the Swift functions, F, in accordance with the full interval, Swift addressing mode described with respect to FIG. 8. The resulting dot products are presented to one input of a combiner 81 via path 95.

MAC 114 receives the incoming data, and after all the information elements of an information vector represented by the incoming column of data have been squared and accumulated, the accumulated sun is presented to look up table 116. As was the case for the full interval, standard addressing apparatus of FIG. 14, LUT 116 contains precalculated virtual information elements for every sum of data squared. The combination of the LUT 116 and the MAC 114, provides an adjustment term generator 80 (FIG. 15) which performs the calculation of the value V of the virtual information elements 42 in accordance with the full interval, Swift addressing mode of FIG. 8. LUT 116 of generator 72D presents the calculated virtual information element or adjustment term to the other input of combiner 81.

Under direction of control signals 68 from controller 69 via path 107, combiner 81 adds the adjustment term to the dot product term signal generated in the row signal generator 73 of the controller.

The combined dot product and virtual information element or adjustment term form the column signals, G(t), which are presented by combiner 81 to frame buffer 82 (FIG. 9), where they are stored. Under direction of controller 69, frame buffer 82 presents these signals to the multi-level column drivers 63, which queue the incoming signals and apply them in parallel to the column electrodes 24 of the display matrix 12.

As was the case for the split interval, Swift addressing apparatus of FIG. 13, row signal generator 73 of controller 69 generates predetermined row signals in the form of the Swift functions, F (FIG. 8), typical of Swift addressing. The row signals are presented to the inputs of row drivers 64, which queue the row signals and apply them in parallel to the row electrodes 22 of the display matrix 12 coincidental with the application of the column signals to the column electrodes. Thus the display matrix 12 is caused to display the desired gray scale image represented by the information of the video signal.

In both the split and full interval, Swift addressing apparatus descriptions, use is made of a "dot product" generator or calculation block to perform a dot product of the information vectors, I, with the Swift functions, F. The specific embodiment of the dot product calculation may take many forms. For example, if Walsh function based Swift functions are used, one skilled in the art will recognize that the dot product is in fact a Walsh transform operation for which much electronic hardware has been developed. Alternatively, the dot product may be performed as a correlation of the information vector with the Swift function, or by using adder and subtractor hardware.

In the more specific example of the full interval, Swift apparatus, hereinafter described with respect to FIGS. 16, 17, display 12 is considered to include 480 rows and 640 columns forming 307,200 pixels. As is common practice, the display may be divided into upper and lower sections of 240 rows each and simultaneously addressed to provide a high selection ratio. In this example the number of multiplexed rows, N, of the display is assumed to be 240.

For this example it will also be assumed that the pixel information elements, I, have 64 gray shades or levels, i.e., $2^n$, where n is the number of gray bits or planes of the information vector, in this example, n=6.

It will also be assumed that the Swift functions, $F_i$, are bi-level and almost cyclic, and have elements which are either +D or −D (FIG. 8). For purposes of simplifying the processing thereof, elements of both the information vectors and the Swift functions may be transformed into digital representations: each information element, I, into binary integers from 0 to 63, and each Swift function, $F_i$, into time-dependent elements $R_i(t)$ having values of one to represent −D and zero to represent +D.

In this specific example, the dot product term of G(t) for each column is performed as a correlation of the information vector with Swift function vectors defined by elements $R_i(t)$ of the set of Swift functions $F_1$ to $F_{240}$ at a particular time t. With the binary transformation of the information elements and the Swift functions, the dot product term becomes:

$$\frac{D}{\sqrt{240}}\ \frac{1}{31.5}\sum_{i=1}^{240}\left[\sum_{g=0}^{5}[2^g(I_{ig}\oplus R_i(t))]-31.5\right]$$

where ⊕ indicates the logical exclusive-or function and $I_{ig}$ is the gth bit plane of the information element $I_i$. The adjustment term for each column is given by:

$$\frac{D}{\sqrt{240}}\ \frac{1}{31.5}\left[(2R_{241}(t)-1]\sqrt{\sum_{i=1}^{240}63I_i-\sum_{i=1}^{240}I_i^2}\right.$$

and this example is based on one virtual information element and one corresponding virtual row.

The data components of video signals 70 (FIG. 9) arrive in horizontal lines of data composed of pixel information elements, I, including the desired gray levels for each pixel, and are stored in frame buffer 71 in the form of a matrix 31 corresponding to the matrix of pixels in display panel 12 (See FIGS. 7, 8). The signal generator 72 (FIG. 9) receives the pixel information elements from storage means 71 in the form of vertical lines of information elements and generates column signals, G, therefrom.

Figure 15:
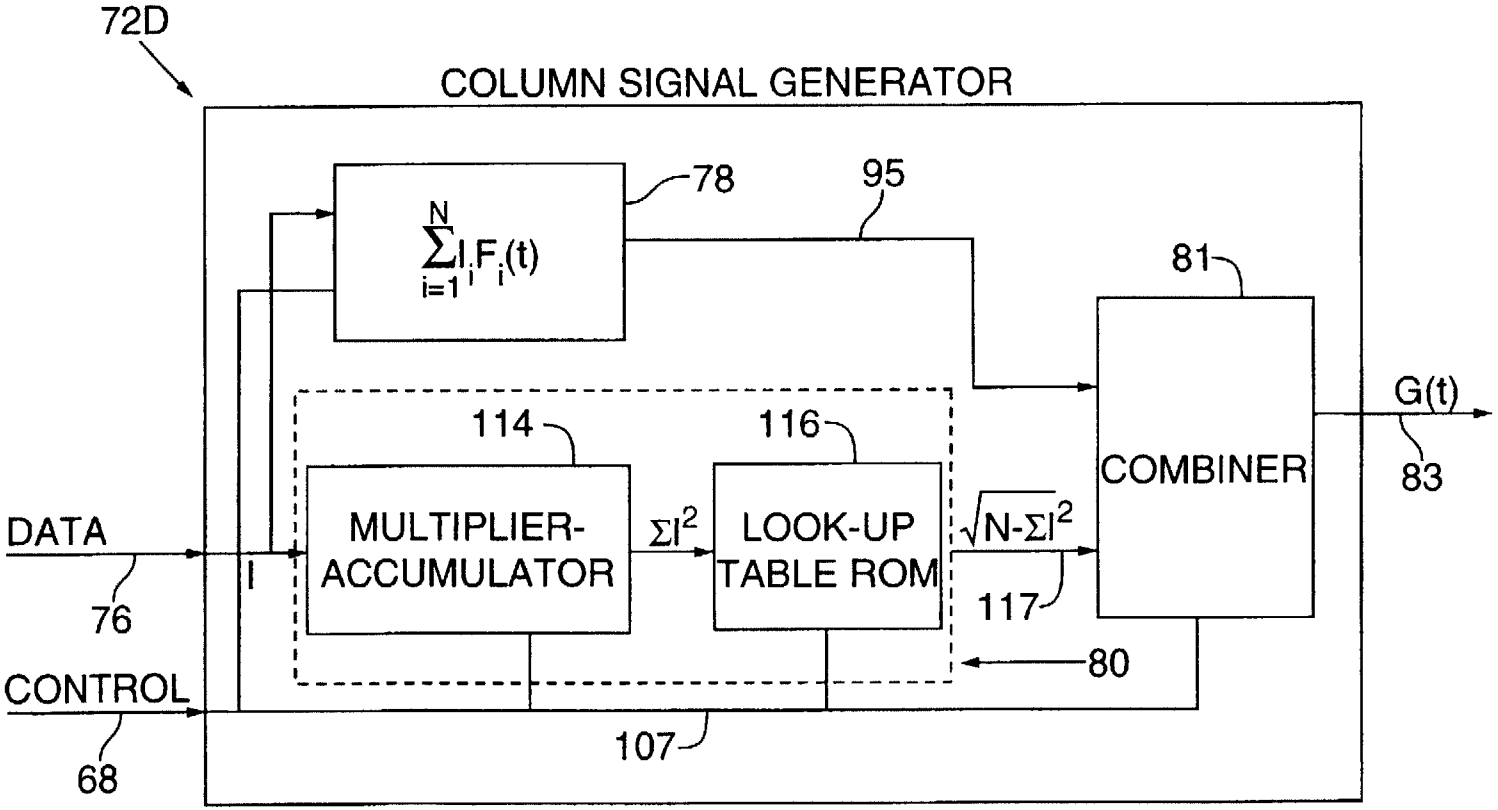
FIG. 15 is a block diagram of the column signal generator of the apparatus of FIG. 9 for operating in the full interval, Swift addressing mode.
Figure 16:
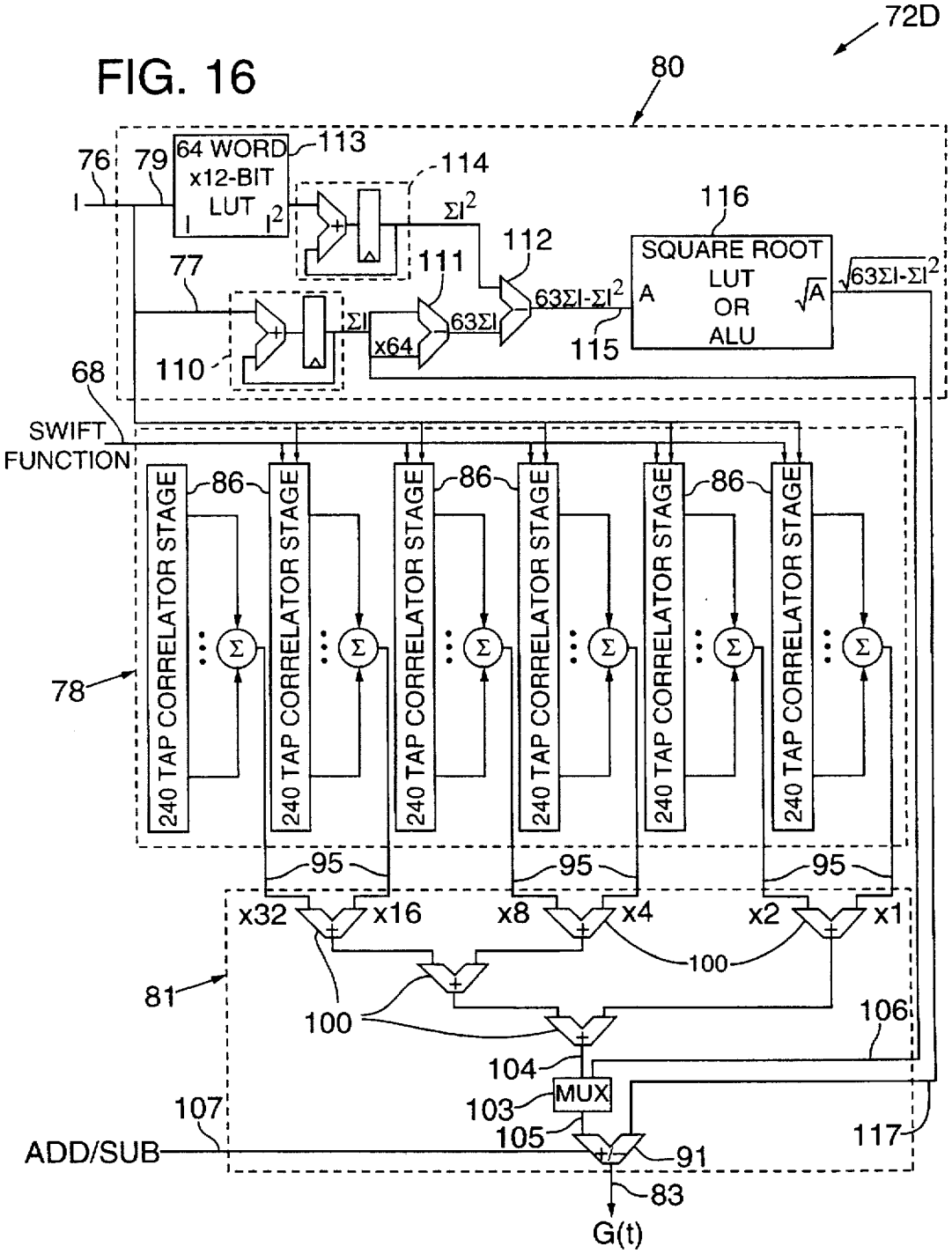
FIG. 16 is a more detailed block diagram and schematic representation of the dot product generator, adjustment term generator and combiner of the column signal generator of FIG. 15.
Figure 17:
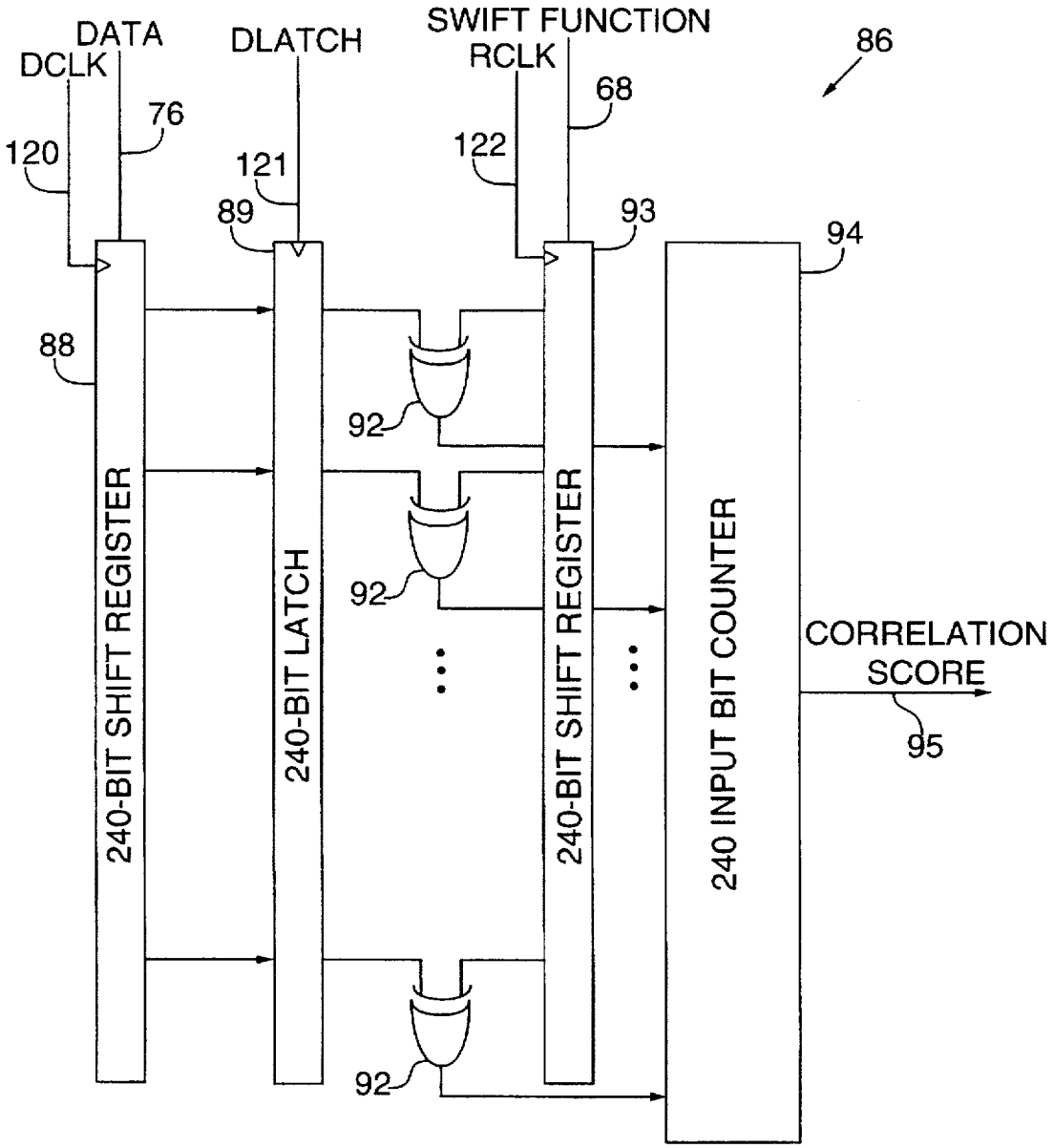
FIG. 17 is a more detailed block diagram and schematic representation of a correlation stage of the dot product generator of FIG. 16.

In the specific form of column signal generator 72D (FIGS. 15, 16) dot product generator 78 comprises six correlation stages, each generally designated 86 (FIG. 16). Each bit plane of the six-bit information elements making up the information vectors is routed to a dedicated correlation stage. Each correlation stage 86 (FIG. 17) is comprised of a 240-bit data register 88, a 240-bit data latch 89, 240 exclusive-or (XOR) gates 92, a 240-bit reference register 93, and a 240 input bit counter 94.

The data (one bit plane of the six-bit information vector) is presented via path 76 to the input of each data register 88, where it is sequentially loaded by a register data clock signal, DCLK, 120. After one information vector is loaded into the data register 88, it is transferred to data latch 89 by clock signal, DLATCH, 121, leaving data register 88 free to receive the next information vector. Both clock signals DCLX and DLATCH are provided from a control component from controller 69 via path 68. The 240 outputs of each data latch 89 are presented to one of the inputs of 240 XOR gate 92.

The 240-bit reference register 93 of each correlation stage 86 is sequentially loaded via line 68 (FIG. 16) with reference Swift functions from controller 69 using reference clock signal, RCLK, 122, provided by controller 69 via path 68.

The 240 outputs of the reference registers 93 (FIG. 17) are presented to the other inputs of the 240 XOR gates 92. When the first Swift function vector is loaded into reference registers 93, the 240 XOR gates 92 compare each pixel information element, I, in data latch 89 with each corresponding Swift function element, F. The outputs of the XOR gates 92 are presented to 240 input bit counter 94, which counts the number of logic high bits present at its 240 inputs and encodes this number as an eight-bit binary word which is presented via path 95 to combiner 81 (FIGS. 15, 16) This eight-bit word is referred to as a "correlation score" between the information vector and the Swift function vector.

For every information vector latched in data latch 89 (FIG. 17), 255 Swift function vectors are loaded into each reference register 93, resulting in 255 correlation scores between the information vector and the 255 Swift function vectors. In this example, the Swift functions are almost cyclic, which allows the 255 Swift functions to be loaded with as few as 255 RCLX pulses (because each RCLX pulse cyclically shifts the previous Swift function vector by one, resulting in the next Swift function vector).

The 256th correlation score is the dot product of the information vector and a constant Swift function vector, and is calculated simply by summing the elements of the information vector. This is performed by an accumulator 110 in association with adjustment term generator 80 (FIGS. 15, 16). Data is presented to the accumulator 110, which accumulates the information elements of the information vector resulting in the 256th correlation score, which is presented to combiner 81.

The adjustment term generator 80 (FIGS. 15, 16) receives data signals 76 from frame buffer 71 via paths 77 and 79 and computes the adjustment term therefrom. From path 77 (FIG. 16) the data is converted by accumulator 110 into a base summation, which is also the last correlation score.

The base summation is also multiplied by 63 by a simple left shift of 6 places (×64), in conjunction with a subtractor 111, and is then fed to a subtractor 112.

From path 79 the data is processed through squaring block 113 (FIGS. 14, 16) followed by an accumulator 114 and thence to subtractor 112 where the results are combined with those from path 77.

The combined result is presented to the input 115 of square root block 116 which results in the derivation of the final adjustment term. From square root block 116 the adjustment term is presented to combiner 81 via line 117 (FIGS. 15, 16), which combines the adjustment term with the correlation scores from generator 78 and results in the desired column signals, G.

Combiner 81 receives the correlation scores from the six correlation stages 86 of dot product generator 78 and the 256th correlation score and the adjustment term from adjustment term generator 80 and combines thou to result in the column signals. Combiner 81 (FIG. 16) binary weights and sums the correlation scores from the six correlator stages 86. The weighting is accomplished by a left shift of 0, 1, . . . , 5 of the correlations scores from the least to most significant correlation stages, respectively. Adders 100 add the weighted correlation scores and present the total to one input of a multiplexer 103 via connection 104. The other input of multiplexer 103 receives the 256th correlation score from adjustment term generator 80 via line 106.

Multiplexer 103 selects between the 255 summed correlation scores generated by the dot product generator 78 and the 256th correlation score generated by the adjustment term generator 80 and presents all 256 correlation scores via line 105 to one input of an adder/subtractor 91 (FIG. 16). The other input of adder/subtractor provides the adjustment term which it adds to or subtracts from the correlation scores in response to a control signal 107 (FIG. 15) supplied by controller 69. Control signal 107 is generated by controller 69 based on the virtual row of the Swift functions.

From combiner 81 (FIG. 16) the adjusted column signals, G, are received in frame buffer 82 via line 84 (FIG. 9). If the signals are processed an digitally encoded signals and the column drivers 63 are of the analog input type, the column signal must first be processed through a digital-to-analog converter 57 (FIG. 11).

The pulse-height modulation method and apparatus of this invention require multi-level LCD column drivers. In general, the number of simultaneously accessible voltages required of the column drivers at any one time depends on the particular mode of addressing implemented, the number of gray levels to be displayed, and, the accuracy of image portrayal required in the application. In practice, currently available multi-level drivers used for pulse-height modulation addressing fall into two categories: digital input type (such as the Hitachi HD66310) which are suitable for applications requiring up to 64 simultaneously accessible voltages, and analog input type (such as the Seiko Epson SED1770) which are suitable for applications requiring in excess of 256 simultaneously accessible voltages. In general, the split interval, standard addressing mode requires fewer simultaneously accessible voltages than the other modes, and can require as few as M simultaneously accessible voltages for displaying M gray levels.

Column signals, G, presented to the inputs of drivers 63, are queued by the drivers in internal sample and hold registers. When all the samples are loaded for a particular time interval, the drivers apply all the samples to the corresponding column electrodes of the display 12 through the driver outputs simultaneously as regulated by control signals from controller 69. While the present samples are being applied to the electrodes, the next set of samples are queued into the drivers for the next time interval. This process repeats for all 256 time intervals of this example, at which time a new frame cycle begins.

The row drivers 64 apply the Swift functions, F, received via line 74 from row signal generator 73 of controller 69 to the row electrodes of the display, in synchronicity with the signals applied to the column electrodes by the column drivers 63. The row drivers may be of the bi-level digital type, similar to the SED1704 model available from Seiko Epson Corporation of Japan. The Swift functions are queued by drivers 64 in shift registers internal to the drivers. After each Swift function vector is loaded, the drivers apply those signals simultaneously to the row electrodes through the driver outputs. The timing of the row driver outputs corresponds to the timing of the column driver outputs so that both the row drivers and column drivers apply their outputs simultaneously, per control signals from controller 69.

Where look up tables (LUT) have been referred to herein (FIGS. 12–16) those skilled in the art will recognize that electronic hardware such as arithmetic logic units (ALU) exists which can perform the required calculations according to the applicable equations at the appropriate times.

What is claimed is:

1. A method for addressing a passive flat panel display in which a plurality of overlapping first and second electrodes on opposite sides of an electro-optical material define a matrix of pixels that display in a frame period information in more than two gray levels, the display being characterized in that the optical state of each pixel is determined by the rms voltage appearing across the pixel over the frame period, the method comprising:

applying first signals that are independent of the information to be displayed to the first electrodes during characteristic time intervals of each frame period;

applying second signals of changing pulse height magnitudes and representative of the information to be displayed to the second electrodes during each frame period, the magnitude of each second signal at any time being chosen from more than two available voltages and being related to the desired gray level of at least one pixel defined by the corresponding second electrode and selected one or ones of the first electrodes.

2. The method of claim 1, in which the desired gray levels of pixels are represented by pixel information elements, the values of which vary between a lower limit and an upper limit, and further comprising generating at least one virtual first signal for at least one virtual first electrode overlapping said second electrodes providing a plurality of virtual information elements; wherein said first signals are applied to select said first electrodes and said virtual first electrodes sequentially; and the amplitude of each second signal is proportional to the pixel information element and the virtual information element of the selected first electrode, respectively, during said time interval.

3. The method of claim 1 in which:

said first signals select each first electrode during more than one time interval over each said frame period;

the desired gray levels of pixels are represented by pixel information elements, the values of which vary between a lower limit and an upper limit; the method further comprising generating at least one virtual first signal for at least one virtual first electrode overlapping said second electrodes providing a plurality of virtual pixels having virtual information elements; wherein the amplitude of each second signal at any time interval is proportional to the sum of the products of the amplitude of each first signal at that time interval and the pixel information element at that first electrode; and adjusted by a term that is proportional to the sum of the products of the amplitude of said virtual first signal at said time interval and the virtual information element at that virtual first electrode.

4. The method of claim 3 in which a single virtual pixel is associated with each second electrode.

5. The method of claim 3 which multiple virtual pixels are associated with each second electrode.

6. The method of claim 1 in which each first signal selects a corresponding first electrode during multiple characteristic time intervals within the frame period.

7. The method of claim 6 in which the selections are distributed throughout the frame period.

8. The method of claim 1 in which each first signal applies to the corresponding first electrode a zero voltage during characteristic time intervals in which the corresponding first electrode is not selected.

9. The method of claim 1 in which at least some of the first signals cause no more than one selection of their corresponding first electrodes during a frame period.

10. The method of claim 1 in which the magnitude of a second signal during a characteristic time interval is determined by the sum of first and second quantities, the first quantity being proportional to a sum of products of the value of the information element of each pixel defined by the overlapping of the corresponding second electrode and first electrodes selected during the time interval by corresponding first signals and the amplitude of the corresponding first signal and the second quantity including a term related to the square of the values of at least some of the information elements of the pixels defined by the corresponding second electrode.

11. The method of claim 10 in which the first quantity is equal to zero during at least one but not all of the characteristic time intervals of the frame period.

12. The method of claim 10 in which during at least one characteristic time interval of the frame period, a second signal is generated and applied when none of the first electrodes is selected.

13. The method of claim 10 in which the second quantity is equal to zero during at least one but not all of the characteristic time intervals of the frame period.

14. The method of claim 10 in which the first quantity is non-zero in at least one characteristic time interval, the second quantity is non-zero in at least one characteristic time interval, and in no characteristic time interval are both the first and second quantities non-zero.

15. The method of claim 1 in which applying second signals includes applying a second signal having during at least some characteristic time intervals of the frame period an amplitude determined by the amplitudes of the first signals causing selections during the characteristic time interval and by pixel input data corresponding to more than two gray levels of pixels defined by the corresponding second electrode; and generating an additional signal and applying it to at least some of the second electrodes at a time during the frame period when none of the first electrodes is selected, the additional signal producing across corresponding pixels an rms voltage over the frame period related to the pixel input data.

16. The method of claim 15 in which the magnitude of the additional signal is determined by the sum of the squares of pixel input data of multiple pixels defined by the corresponding second electrode.

17. The method of claim 1, in which the desired gray levels of the pixels are represented by pixel information elements, the values of which vary between a lower limit and an upper limit, and in which the magnitude of at least one of the second signals during a characteristic time interval is determined by the value of the information element of each pixel defined by the intersection of the corresponding second electrode and selected ones of the first electrodes and by a term related to the sum of the squares of the values of at least some of the information elements of the pixels defined by the corresponding second electrode.

18. The method of claim 1, in which the desired gray levels of the pixels are represented by pixel information elements, the values of which vary between a lower limit and an upper limit, and in which the magnitude of at least one of the second signals during a characteristic time interval is related to the square root of a quadratic equation including as a variable the value of the pixel information element of at least one first electrode selected by a corresponding first signal.

19. The method of claim 1, in which the desired gray levels of the pixels are represented by pixel information elements, the values of which vary between a lower limit and an upper limit, and in which multiple virtual information elements are defined by virtual pixels defined by a virtual first electrode overlapping the second electrodes, the method further including applying to the second electrodes second signals having magnitudes related to the values of the information elements and the virtual information elements of the respective pixels and virtual pixels defined by the corresponding second electrode and selected ones of the respective first or virtual first electrode.

20. The method of claim 19 in which each of the first electrodes and virtual first electrodes is periodically selected and the magnitudes of the second signals are proportional to the information elements of the pixels defined by the overlap of the corresponding second electrodes with the selected one of the first electrodes and the virtual first electrodes.

21. The method of claim 19 in which each of the first electrodes and virtual first electrodes is selected multiple times during the frame period and the magnitudes of the second signals are proportional to the information elements of the pixels or virtual pixels defined by the overlap of the corresponding second electrodes with the selected one or ones of the first electrodes and the virtual first electrodes.

22. The method of claim 19 in which the magnitudes of the second signals are proportional to the virtual information elements of the virtual pixels defined by the overlap of the corresponding second electrodes with the virtual first electrode during time intervals in which no first electrode is selected.

23. The method of claim 19 further comprising:

generating at least one virtual first signal for at least one virtual first electrode that defines a plurality of virtual pixels each corresponding to a second electrode and represented by a virtual information element having a value determined from the values of more than one pixel information element representing pixels defined by the corresponding second electrode; and in which the magnitude of at least one of the second signals at any time interval is determined by a sum of first and second quantities, the first quantity being proportional to the sum of the products of the amplitude of each first signal causing a selection of a first electrode at that time interval and the pixel information element of the pixel defined by the corresponding first and second overlapping electrodes and the second quantity representing a sum of quantities derived for each of the virtual rows, each virtual row contributing to the sum a quantity proportional to the product of the amplitude of the corresponding virtual first signal at the time interval and the virtual information element of the virtual pixel defined by the virtual first electrode and the corresponding second electrode.

24. The method of claim 19 further comprising:

generating at least one virtual first signal for at least one virtual first electrode that defines a plurality of virtual pixels, each corresponding to a second electrode and represented by a virtual information element having a value determined from the values of more than one pixel information element representing pixels defined by the corresponding second electrode; and in which the magnitude of at least one second signal is related during at least one characteristic time interval of the frame period to a sum of the products of the amplitude of each first signal causing a selection of a first electrode at that time interval and the pixel information element of the pixel defined by the corresponding first and second overlapping electrodes and the magnitude of at least one of the second signals being related during at least one characteristic time interval of the frame period to a product of the amplitude of a virtual first signal during the time interval and the virtual information element of the virtual pixel defined by the corresponding virtual electrode and the corresponding second electrode.

25. The method of claim 24 in which the magnitude of at least one second signal during at least one time interval of the frame period is related to a sum of products of the amplitude of corresponding virtual first signals at the time interval and virtual information elements of virtual pixels defined by the virtual electrode and the corresponding second electrode.

26. The method of claim 24 in which the magnitude of at least one second signal is related during different characteristic time intervals of the frame period to a sum of the products of the amplitude of each first signal causing a selection of a first electrode at that time interval and the pixel information element of the pixel defined by the corresponding first and second overlapping electrodes or to a product of the amplitude of a corresponding virtual first signal at the time interval and the virtual information element of the virtual pixel defined by the virtual electrode and the corresponding second electrode.

27. The method of claim 24 in which the magnitude of at least one second signal is related during a single characteristic time intervals of the frame period to a sum of the products of the amplitude of each first signal causing a selection of a first electrode at that time interval and the pixel information element of the pixel defined by the corresponding first and second overlapping electrodes or to a product of the amplitude of a corresponding virtual first signal at the time interval and the virtual information element of the virtual pixel defined by the virtual electrode and the corresponding second electrode.

28. The method of claim 1, in which the desired gray levels of the pixels are represented by pixel information elements, the values of which vary between a lower and an upper limit, and in which the magnitude of each second signal during the time interval is proportional to a sum of products of the value of the information element of each pixel defined by the corresponding second electrode and the amplitude of the first signal of the corresponding first electrode, the magnitude of the second signal being determined by adding to the product a term related to the square of the values of the information elements of the pixels defined by the corresponding second electrode.

29. A method for addressing a passive flat panel display in which a plurality of overlapping first and second electrodes on opposite sides of an electro-optical material define a matrix of pixels that display in a frame period information in more than two gray levels, the display being characterized in that the optical state of each pixel is determined by the rms voltage appearing across the pixel over the frame period, the method comprising:

generating a series of first signals that are independent of the information to be displayed;

applying the first signals to the first electrodes during characteristic time intervals of each frame period;

generating a series of second signals of changing pulse height magnitudes and representative of the information to be displayed;

applying the second signals to the second electrodes during the characteristic time intervals of each frame period;

the magnitudes of the second signals at any time during a characteristic time interval being chosen from more than two available voltages and being related to the desired gray level of at least one pixel defined by the corresponding second electrode.

30. Apparatus for addressing a passive flat panel display in which a plurality of overlapping first and second electrodes on opposite sides of an electro-optical material define a matrix of pixels that display information in a more than two gray levels, the display being characterized in that the optical state of each pixel is determined by the rms voltage appearing across the pixel over the frame period, the apparatus comprising:

means for driving the first electrodes during characteristic time intervals of each frame period with first signals which are independent of the information to be displayed; and means for driving the second electrodes during each frame period with second signals, each of which is representative of the information to be displayed and whose pulse height amplitude at any time is chosen from more than two available voltages and is related to the desired gray level of at least one of the pixels defined by the second electrode.

31. Apparatus for converting video signals including control components and information components into signals for addressing a passive flat panel display in which a plurality of overlapping first and second electrodes on opposite sides of electro-optical material define a matrix of pixels that display information in more than two gray levels, the display being characterized in that the optical state of each pixel is determined by the rms voltage appearing across the pixel over the frame period, the apparatus comprising:

first signal generating means for generating a series of first signals which are independent of the information component of the video signals;

means for applying the first signals to the first electrodes during characteristic time intervals of each frame period;

second signal generating means for generating during subintervals of the characteristic time intervals second signals of changing pulse height magnitude selected from more than two available voltages and representative of the information component of the video signals including gray levels and the amplitude of each of which at any time is related to the desired gray level of at least one of the pixels;

means for applying the second signals to the second electrodes during each frame period coincidentally with the application of the first signals to the first electrodes.

32. The apparatus of claim 31, including:

control signal generating means for generating control signals related to the control components of the video signals; and the means for applying the first and second signals to their respective electrodes being controlled by the control signal generating means.

33. The apparatus of claim 31, in which:

the desired gray levels of the pixels are represented by pixel information elements, the values of which vary between a lower limit and an upper limit;

said first signal generating means including means for generating at least one virtual first signal for at least one virtual first electrode overlapping said columns providing a plurality of virtual information elements;

said means for applying said first signals applies said first signals to select said first electrodes and said virtual first electrodes sequentially; and said second signal generating means generates second signals the amplitude of each of which is proportional to the pixel information element and the virtual information element of the selected first electrode, respectively, during the time interval that each said first electrode is selected.

34. The apparatus of claim 31, in which:

said first signal generating means generates first signals that select each first electrode more than once during a frame period;

the desired gray levels of the pixels are represented by pixel information elements, the values of which vary between a lower limit and an upper limit;

said second signal generating means includes means for generating at least one virtual first signal for at least one virtual first electrode overlapping said second electrode providing a plurality of virtual information elements; and said second signal generating means generates second signals the amplitude of each of which at any characteristic time interval is proportional to the sum of the products of the amplitude of each first signal at that time interval and the pixel information element at that first electrode, adjusted by a term that is proportional to the sum of the products of the amplitude of said virtual first signal at said time interval and the virtual information element at that virtual first electrode.

35. The apparatus of claim 31, in which:

the first signal generating means generates first signals that are orthonormal functions selecting each first electrode more than once during a frame period;

the desired gray levels of the pixels are represented by pixel information elements; and the second signal generating means includes dot product generating means for generating a dot product term of each first signal and the corresponding bit plane of the pixel information element.

36. The apparatus of claim 35, in which:

said first signal generating means includes means for generating at least one virtual first signal for applying to a virtual first electrode;

said second signal generating means includes means for generating a plurality of virtual information elements for at least one virtual first electrode overlapping said second electrodes;

adjustment term generating means for generating an adjustment term that is proportional to the sum of the products of the amplitude of said virtual first signal and the virtual information element at the corresponding virtual first electrode, and combiner means for combining said dot product term and said adjustment term to provide said second signal.

37. The apparatus of claim 34 in which each first signal selects a corresponding first electrode during multiple characteristic time intervals distributed within the frame period.

* * * * *

UNITED STATES PATENT AND TRADEMARK OFFICE

CERTIFICATE OF CORRECTION

PATENT NO. : 5,767,836
APPLICATION NO. : 08/486369
DATED : June 16, 1998
INVENTOR(S) : Terry J. Scheffer et al.

It is certified that error appears in the above-identified patent and that said Letters Patent is hereby corrected as shown below:

Column 1
Line 4, "...issued May 16, 1995..." should read --...issued October 17, 1995...--.

Signed and Sealed this

Seventeenth Day of November, 2009

David J. Kappos

David J. Kappos
*Director of the United States Patent and Trademark Office*